US011354943B2

(12) United States Patent
Heard et al.

(10) Patent No.: US 11,354,943 B2
(45) Date of Patent: Jun. 7, 2022

(54) ASSET MAP VIEW, DWELL TIME, PRE-POPULATE DEFECTS, AND VISUAL-INSPECTION GUIDANCE

(71) Applicant: Zonar Systems, Inc., Seattle, WA (US)

(72) Inventors: Kayla Heard, Kent, WA (US); Jessica Randall, Seattle, WA (US); Alejandro Vazquez, Seattle, WA (US); Jerissa Lumansoc, Shoreline, WA (US); Joseph D. M. Kane, Seattle, WA (US); Elias L. Cole, III, Seattle, WA (US); Henry Kevin Mest, Edmonds, WA (US); Drory Ben-Menachem, Bainbridge Island, WA (US); Stephen Brown, Renton, WA (US)

(73) Assignee: Zonar Systems, Inc., Seattle, WA (US)

( * ) Notice: Subject to any disclaimer, the term of this patent is extended or adjusted under 35 U.S.C. 154(b) by 0 days.

(21) Appl. No.: 17/187,444

(22) Filed: Feb. 26, 2021

(65) Prior Publication Data

US 2021/0272387 A1 Sep. 2, 2021

Related U.S. Application Data

(60) Provisional application No. 62/983,327, filed on Feb. 28, 2020.

(51) Int. Cl.

| | |
|---|---|
| ***G06G 7/00*** | (2006.01) |
| ***G07C 5/00*** | (2006.01) |
| ***G07C 5/08*** | (2006.01) |

(52) U.S. Cl.

CPC ..... *G07C 5/008* (2013.01); *G07C 5/0825* (2013.01); *G07C 5/0833* (2013.01)

(58) Field of Classification Search

CPC .... G07C 5/008; G07C 5/0825; G07C 5/0833; G07C 2205/02; G07C 5/0816

See application file for complete search history.

(56) References Cited

U.S. PATENT DOCUMENTS 6,397,131 B1 * 5/2002 Busch ..... B60R 16/0234 701/33.4

6,622,264 B1 9/2003 Bliley et al.

(Continued)

FOREIGN PATENT DOCUMENTS

CN 106022619 A 10/2016

CN 106056695 A 10/2016

(Continued)

OTHER PUBLICATIONS

Defiance Technology for Business Excellence "Vehicle inspection goes mobile", Case Study: Intel Atom processor Z2430, Intel Xeon processor E7 Family, 2013, 329346-001US, Intel Corporation.

(Continued)

*Primary Examiner* — Munear T Akki

(57) ABSTRACT

An operator's proximity to an automotive vehicle being inspected is tracked and recorded. An audio and/or a visual representation of the automotive vehicle being inspected, inspection zones, and components within the inspection zones are rendered. A representation of the automotive vehicle being inspected is updated to reflect a condition of the vehicle being inspected, a condition of the inspection zones, and the numbers of defects for each of inspection zones. The audio and visual representations shown as part of any defects of the vehicle being inspected may be recorded. During a vehicle inspection, a visual indication of a driver's location in proximity to a visual representation of the automotive vehicle being inspected may be displayed.

9 Claims, 46 Drawing Sheets

(56) References Cited

U.S. PATENT DOCUMENTS

| | | | | |
|---|---|---|---|---|
| 7,020,580 | B2 | 3/2006 | Peters et al. | |
| 7,117,121 | B2 | 10/2006 | Brinton et al. | |
| 8,106,757 | B2 | 1/2012 | Brinton et al. | |
| 8,443,301 | B1 * | 5/2013 | Easterly | G07C 5/006 715/848 |
| 8,739,059 | B2 | 5/2014 | Rabenold et al. | |
| 9,454,854 | B2 | 9/2016 | Easterly et al. | |
| 9,533,773 | B1 | 1/2017 | Jang et al. | |
| 9,582,944 | B2 | 2/2017 | Merg et al. | |
| 9,904,908 | B2 | 2/2018 | Couch | |
| 10,152,836 | B2 | 12/2018 | Rozint | |
| 10,275,953 | B2 | 4/2019 | Cronin et al. | |
| 10,304,260 | B2 | 5/2019 | Jelinek et al. | |
| 10,373,402 | B2 * | 8/2019 | Kwak | G08G 1/20 |
| 10,607,084 | B1 * | 3/2020 | Tang | G06T 7/20 |
| 2005/0216326 | A1 | 9/2005 | Inoue et al. | |
| 2005/0273228 | A1 | 12/2005 | Tsubota et al. | |
| 2009/0265357 | A1 | 10/2009 | Yukawa et al. | |
| 2012/0158238 | A1 | 6/2012 | Daley et al. | |
| 2012/0166346 | A1 * | 6/2012 | Mach | G06Q 30/018 705/317 |
| 2014/0337319 | A1 | 2/2014 | Rackwitz | |
| 2015/0026696 | A1 | 1/2015 | Gillam | |
| 2015/0186896 | A1 | 7/2015 | Vass | |
| 2017/0116792 | A1 | 4/2017 | Jelinek et al. | |
| 2017/0236075 | A1 | 8/2017 | Shi | |
| 2018/0025392 | A1 | 1/2018 | Helstab | |
| 2018/0293817 | A1 | 10/2018 | Gruzinger, Jr. et al. | |
| 2019/0279444 | A1 | 9/2019 | McQuade | |
| 2019/0295331 | A1 | 9/2019 | Anit et al. | |
| 2020/0142923 | A1 | 5/2020 | Kusaki et al. | |
| 2020/0151974 | A1 * | 5/2020 | Ghosh | G07C 5/0866 |
| 2021/0003481 | A1 * | 1/2021 | Strege | G07C 5/0808 |

FOREIGN PATENT DOCUMENTS

| | | | |
|---|---|---|---|
| CN | 107330812 | A | 11/2017 |
| CN | 108008714 | A | 5/2018 |
| CN | 109863514 | A | 6/2019 |
| CN | 110245583 | A | 9/2019 |

OTHER PUBLICATIONS

Christopher W Ferrone, "Electronic Vehicle Inspection Reports; A Field Evaluation", SAE Technical Paper Series 2004-01-2648; Commercial Vehicle Engineering Congress and Exhibition, Rosemont, Illinois, USA, Oct. 26-28, 2004, SAE International.

* cited by examiner

ZONAR EVIR

5

Regional Reggie Pepsi NW

Dwell Time Report

Minimum Duration
Inspection 5:00
Zone 1:00

Maximum Duration
Inspection 30:00
Zone 5:00
Between Zones 1:00

Asset, Inspector Or Asset Location | Date Range Previous 7 Days | Asset Type | Severity

| Driver | Date | Time | Asset Number | Asset Location | Inspection | Zone | Between Zones |
|---|---|---|---|---|---|---|---|
| David Otro | 05/02/2019 | 20:46:07 | 1234567890TRK | Jackson | 45:20 | Zone 5 - 0:23 | Zone 1-12:00 |
| David Otro | 05/02/2019 | 20:46:07 | 7864532987TRK | Memphis | 15:00 | All Ok | All Ok |
| Ann Park | 04/30/2019 | 20:46:07 | 0098734265TRK | Miami | 10:53 | Multiple Violations | All Ok |
| Eugene Hill | 04/29/2019 | 20:46:07 | 5432765487TRK | Tampa | 13:04 | All Ok | Zone 2-3:00 |
| David Otro | 04/29/2019 | 20:46:07 | 1234567890TRK | Jackson | 12:00 | All Ok | All Ok |
| Ann Park | 04/28/2019 | 20:46:07 | 0007643678TRK | Miami | 2:32 | Multiple Violations | All Ok |

Support Terms & Conditions Data Disclosure

ZONAR ©2019 Zonar Systems

Support Phone: 877-843-3847 customercare@zonarsystems.com

FIG. 16

ZONAR EVIR

5

Regional Reggie
Pepsi NW

Customize Inspection Guidance

ASSET TYPE: Straight Truck

Inspection Options

| | |
|---|---|
| Zone Order Enforced | No |
| Show Guidance Text | Yes |
| Show Displayed Instructions | Yes |
| Enable Audio Guidance | Yes |
| Enable Tactile Feedback | No |
| Zone Icons | Blue Circle |

Zone Order

| Order | Zone Labels | Guidance Text | Displayed Instructions |
|---|---|---|---|
| 1 | A | Start Here | This Is First Area Of The Vehicle To Inspect. Walk Here... |
| 2 | C | Continue To Next Zone | Please Walk To The Next Area Of The Vehicle And Tap The... |
| 3 | B | Continue To Next Zone | Lorem Ipsum Dolor Sit Amet |
| 4 | D | Continue To Next Zone | Lorem Ipsum Dolor Sit Amet |
| 5 | E | Continue To Next Zone | Lorem Ipsum Dolor Sit Amet |
| 6 | F | Continue To Next Zone | Lorem Ipsum Dolor Sit Amet |
| 7 | G | Inspection Complete | Lorem Ipsum Dolor Sit Amet |

Support Terms & Conditions Data Disclosure

ZONAR ©2019 Zonar Systems Support Phone: 877-843-3847 customercare@zonarsystems.com

FIG. 24

Perform Inspection

Map View | List View

Asset Details (2 Assets)

Power Unite

Open Defects Detected

This Asset Has 5 Defects That Are Still Unresolved.

Do You Want To Add These To Your Inspection?

| Zone | Component | Defect | |
|---|---|---|---|
| Front | Bumper | Dent | Added |
| Front | Tire | Flat | Add |
| Right Side | Door | Scratch | Add |
| Left Side | Mirror | Loose | Add |
| Rear | Window | Cracked | Add |
| | | Add None | Add All |

Zone: Front Left

FIG. 28C

Submit Inspection

Elapsed Time 00:00

Map View | List View

Asset Details
Primary Asset Name + 1 Asset

Open Defects Detected

This Asset Has 5 Defects That Are Still Unresolved. These Are Not Included In The Inspection You're About To Submit.

Do You Want To Add Them To Your Inspection?

| Zone | Component | Defect | |
|---|---|---|---|
| Front | Bumper | Dent | Added |
| Front | Tire | Flat | Add |
| Right Side | Door | Scratch | Add |
| Left Side | Mirror | Loose | Add |
| Rear | Window | Cracked | Add |

Add None | Add All

- Open
  Engine > Fan/Belt > Minor
  This Is A Note.

FIG. 32A

ASSET MAP VIEW, DWELL TIME, PRE-POPULATE DEFECTS, AND VISUAL-INSPECTION GUIDANCE

BACKGROUND

Embodiments of the invention relate generally to automotive telematics and more particularly to electronic daily vehicle inspection reports (eDVIRs).

Descriptions of asset zones to be inspected during DVIR (Daily Vehicle Inspection Report) inspections are typically text-only, and represent different physical areas on different makes and models of vehicles. This frequently leads to lost time during the inspection process while the driver physically locates the zones on the asset and components within the zones based on these descriptions.

Ensuring vehicle inspections are done properly in real time to create a higher degree of safety compliance for the vehicle under consideration would advance the state of the art.

BRIEF SUMMARY

In accordance with embodiments of the invention, an operator's proximity to an automotive vehicle being inspected is tracked and recorded. An audio and/or a visual representation of the automotive vehicle being inspected, inspection zones, and components within the inspection zones are rendered. A representation of the automotive vehicle being inspected is updated to reflect a condition of the vehicle being inspected, a condition of the inspection zones, and the numbers of defects for each of inspection zones. The audio and visual representations shown as part of any defects of the vehicle being inspected may be recorded. During a vehicle inspection, a visual indication of a driver's location in proximity to a visual representation of the automotive vehicle being inspected may be displayed.

BRIEF DESCRIPTION OF THE DRAWINGS

FIG. 16 depicts an example dwell-time report identifying abnormal inspection data.

FIG. 24 depicts an example implementation of configurable inspection guidance, configurable indicator types, and configuration of inspection guidance.

FIGS. 28A-28E depict displaying to an operator open defects for an asset with an option to add defects to an inspection.

FIGS. 32A-32B depict examples of surfacing open defect information at different areas in the inspection workflow (inspection end, read-only, and actionable).

DETAILED DESCRIPTION

Figure 1:
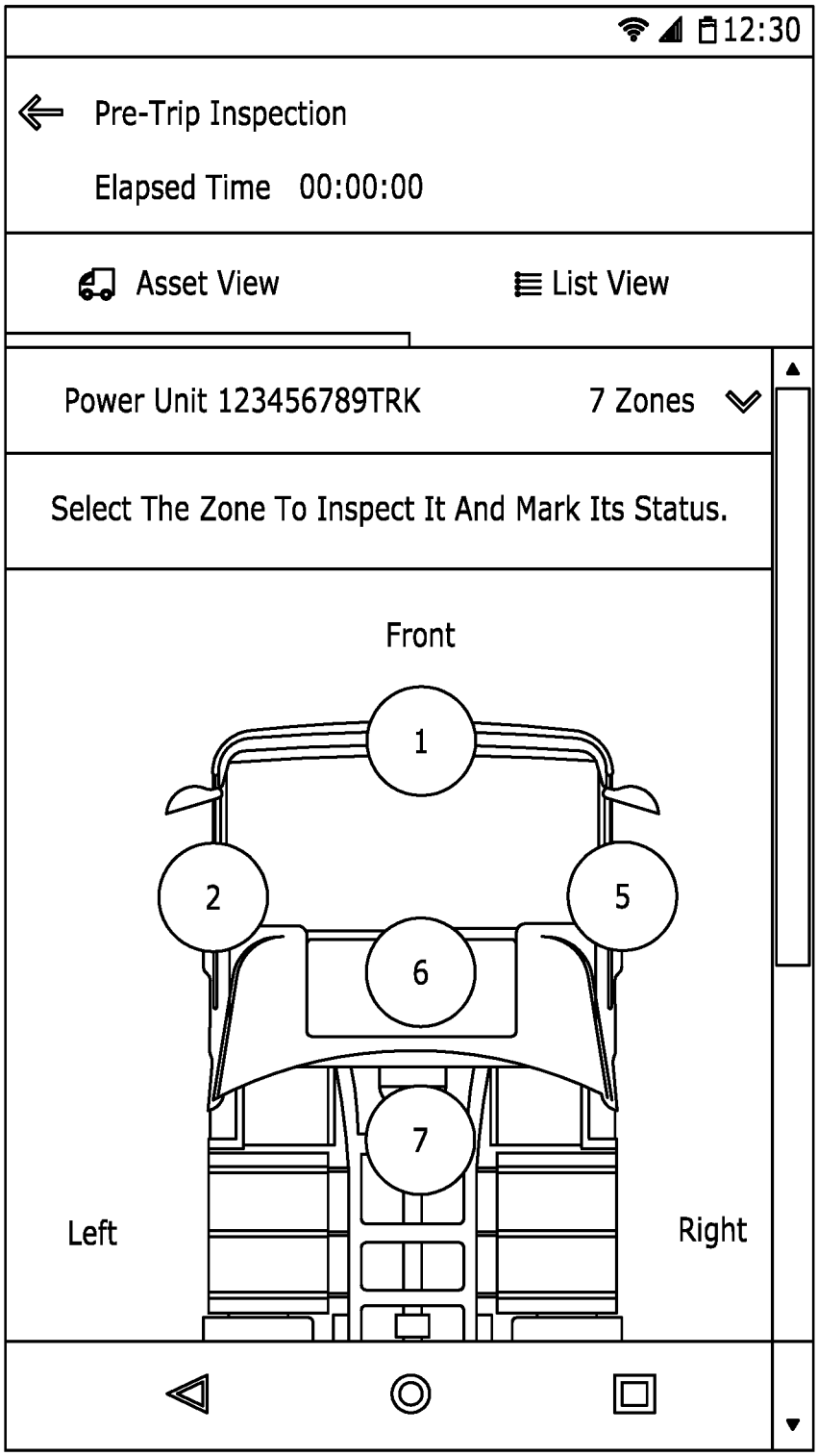
FIG. 1 depicts an example graphical user interface for electronic daily vehicle inspection report (eDVIR) mobile app.

Embodiments of the invention are directed to integrating a visual representation of an asset (e.g., a tractor trailer) to be inspected within an electronic DVIR application, with additional visual representations of the zones and/or components to be inspected in relation to their location on the asset.

Incorporating a visual representation of the inspected asset into an electronic DVIR solution can increase inspection efficiency and decrease time to train users that are unfamiliar with conducting inspections, users that are unfamiliar with motor carriers' inspection policies, and users that are unfamiliar with the layout of specific asset make/models.

Definitions

DVIR—Paper form used to record asset inspections.

Electronic DVIR or e-DVIR—Software used to electronically record asset inspections.

Motor Carrier or Company—the company which hires the end user and is required to keep DVIRs or e-DVIRs on hand.

Driver (also referred to herein as Operator)—the employee of the company performing inspections and/or operating the asset.

Asset—the object being inspected; may refer to a building, machinery, items attached to vehicles, or any on-road or off-road vehicle of any classification.

Zone—the area of the asset to inspect

Component—items to inspect within each zone

Defect—breakages found within components of a zone

Condition—degree to which a defect affects the ability to safely operate an asset Mobile Inspection Device—a remote computing device (e.g., a tablet computer, a smart phone, personal digital assistant, and the like) used to record an electronic DVIR Visual Representation of Asset—Depiction of the asset being inspected. May be in any image or file format and include text, additional graphics, or tactile communication to the user.

Dwell Time Report—a report that includes: the duration spent inspecting individual zones and/or components; and the duration spent in between inspecting individual zones and/or components.

Visual Representation of Asset—Depiction of the asset being inspected. May be in any image or file format and include text, additional graphics, or tactile communication to the operator.

Visual Guidance—Instructions to the operator on next steps to take in their inspection, based on their current progress.

Open Defect—defect record which has not been resolved

Resolved Defect—defect record which has been repaired or marked as unneeded by the motor carrier Problems Existing forms for conducting Daily Vehicle Inspection Reports (DVIRs) as well as all existing apps and SaaS solutions for conducting electronic DVIR reports provide a brief, text-only description of zones to inspect on an asset.

This frequently leads to lost time during the inspection process while the driver physically locates the zones on the asset and components within the zones based on these descriptions, mainly due to:

Differences in zone location based on asset type, make, and model

Driver's level of experience in performing DVIR inspections

Company policy around conducting DVIR inspections May include non-standard zones not specified in US federal guidelines on how to conduct DVIRs May include non-standard procedures (i.e. enforcing order of zone inspections) not covered in basic driver training May include additional procedures unique to SaaS solutions adopted by the company Due to the fact that textual zone descriptions are often short and high-level, drivers may unintentionally miss physical areas of the asset which need to be inspected, or misinterpret the parameters of the physical area to be inspected on the asset.

Motor carriers commonly record duration of a Daily Vehicle Inspection Record (DVIR) as an indicator of the accuracy or quality of that inspection, as a means of ascertaining how likely it is that the operator who conducted that inspection detected all necessary defects with the asset. These are often automatically recorded via an electronic DVIR software application.

Operators who believe they do not have time to do a thorough inspection or do not agree with the motor carrier's standards for a thorough inspection would naturally have a shorter inspection duration than the motor carrier expects. This results in the motor carrier taking actions to re-train or reprimand the operator, unless the operator takes steps to falsify their inspection duration.

If only the inspection duration is recorded, it is easy and common for operators to artificially inflate their inspection times by keeping the electronic DVIR application active while doing activities other than inspecting, either in one long instance or in between inspecting zones. This means that if the operator is doing a cursory or low-quality inspection, the motor carrier does not notice and will not have the opportunity to correct this if they are only shown the total inspection duration, resulting in a higher chance of missed defects.

Even when recorded inspection durations reflect the actual time spent conducting an inspection, existing Software as a Service (SaaS) solutions only provide inspection duration as a single data point per inspection. They do not provide a way to identify data outliers or call out inspection patterns that may indicate duration falsification. Motor carriers must incur extra time or cost to analyze their data to detect emergence and duration of these patterns.

Existing forms for conducting Daily Asset Inspection Reports (DVIRs) as well as all existing apps and SaaS solutions for conducting electronic DVIR reports provide either no guidance to the operator during the inspection, or brief, text-only guidance. A longer inspection time results in monetary losses as the operator attempts to locate the zone on the asset they must inspect, especially on vehicle makes and models they are not familiar with.

Existing forms for conducting Daily Vehicle Inspection Reports (DVIRs) as well as all existing apps and SaaS solutions for conducting electronic DVIR reports provide either no guidance to the operator during the inspection, or brief, text-only guidance.

Many companies offering electronic DVIR applications provide training videos or materials to operators, but these are available outside of the actual application and lead to lost time during the inspection process while the operator locates and views the training materials, and then switches back to the electronic DVIR solution to attempt to incorporate their learnings. The American Psychological Association cites multiple studies that report even brief switching between tasks, or "multitasking", can cause up to a 40% decrease in productivity for the time taken to complete those tasks. American Psychological Association. (2019). Multitasking: Switching costs. Retrieved from https://www.apa.org/research/action/multitask.

Time lost due to multitasking is compounded when the operator is unfamiliar with the procedure required by the motor carrier to inspect a specific asset. This can vary with:

An operator's level of experience in performing DVIR inspections;

An operator's familiarity with the asset type, make, and model;

A company policy around conducting DVIR inspections;

Inclusion of non-standard zones not specified in US federal guidelines on how to conduct DVIRs;

Inclusion of non-standard procedures (i.e. enforcing order of zone inspections) not covered in basic operator training;

Requirements for entering non-standard information (i.e. route or shipping number) not covered in basic operator training; and Inclusion of additional procedures unique to SaaS solutions adopted by a vehicle-fleet owner.

Solutions

Integrate a visual representation of the asset to be inspected within an electronic DVIR application, with additional visual representations of the zones and/or components to be inspected in relation to their location on the asset.

This solves the issue of lost time in trying to locate zones based on a textual description, as the driver will be able to see where each inspection zone is physically located within the asset. The same is true for the issue of being able to locate all components within a zone.

It also solves the problem of additional lost time searching for zones on an asset when transitioning to a new motor carrier, asset type, or asset make/model, as the visual representation can be customized to fit any asset, number or location of zones, or non-standard inspection workflows that the motor carrier may have. Experiments indicate that individuals learn more quickly when given a "location task", or a task where the item location was fixed, in comparison to a "search task", or a task where the item location was randomized. Bishu and Chen, Y. (1989). Bishu, R. R., & Chen, Y. (1989). Learning and transfer effects in simulated industrial information processing tasks. International Journal of Industrial Ergonomics, 4, 237-243.

The visual representation of the asset also reduces the learning curve for new drivers; it can be used as a visual training tool even for basic inspection training, to show where all of the federally required inspection zones are located on all types of assets.

Use Cases

Visual Representation of Zones on an Asset

A visual representation of the asset is displayed to the driver as they are creating a new electronic DVIR inspection, with the location of zones indicated in the appropriate places on the visual representation. The location of zones can be indicated with audio or visual guidance, and/or with tactile feedback through the mobile inspection device as well.

As the driver inspects zones of the asset, the visual representation may update to show the driver's progress and may indicate if the inspection is complete or incomplete.

The visual representation of the asset and the inspection data entered by the driver may be stored as part of the inspection record, and be viewed later in a read-only format by the driver or the motor carrier. This visual representation may also be linked or stored as part of the record of individual defects, which are obtained from the inspection record.

Additional Embodiment: Visual Representation of Components Within Zones, and Potential Defects Within Components As the driver inspects a zone, they may be shown a visual representation of the zone, illustrating what area of the asset is encompassed by the zone. This may optionally include text, audio, or graphic indicators of the components within the zone and their location.

The driver will be asked to indicate whether there are any defects present in the zone and if so, which components they belong to. If defects are indicated, the driver must specify if the vehicle remains drivable or is no longer drivable due to the defect. The visual representation may be read-only or it may update to reflect the driver's input regarding the condition of the components, any defects present, and the severity of those defects.

Indicators of Asset, Zone, or Component Condition

As part of their DVIR inspection, a driver may enter data about the presence of any defects on the asset. If any are present, they will specify the zone to which it belongs, the component in that zone, and what condition exemplifies the defect. They will also enter a severity, indicating whether the defect makes the asset non-operable, or if the asset is still operable despite the defect.

The visual representation of the asset, zone(s), or component(s) may update during or after the inspection to indicate the absence or presence of defects. This may also include the count of defects present, the severity of defects present, and whether the overall asset, zone(s), or component(s) are deemed suitable for operation based on the defects entered.

Audio Description of Asset, Zone, or Component

The visual representation of the asset, zone, and/or component may be accompanied by audio descriptions of the same, including but not limited to:

Physical description of the asset, zone, or component to be inspected

Condition or any present defects as reported by the user

Instructions for the inspection process

Alerts, warnings, or notifications related to the inspection workflow.

Indicator of Driver's Proximity to Asset, Zone, or Component

The audio or visual representation of the asset may also include an indicator of the driver's physical location in relation to the asset. This may be static or update in real-time according to the driver's movement, and may be derived from data collected by the mobile inspection device or by using sensor or camera equipment attached to the asset.

Likewise, as a driver approaches and inspects a zone or component, the audio or visual representations of such may use the same sources to show the driver's location in relation to them, or their actions as they go about the inspection. This may be recorded as part of the inspection record and replayed later by the driver or motor carrier.

The embodiments discussed above provide the following features:

Ability to use audio or visual representation of an asset, in any form, as part of an electronic DVIR solution.

Audio or visual indicators of zones on an asset as part of an electronic

DVIR solution.

Audio or visual indicators showing the location of components within zones as part of an electronic DVIR solution.

Audio or visual indicators of asset condition, zone condition, and count of defects contained within the inspection record.

Linking audio or visual representation of an asset, zone, component, or any combination thereof to the inspection record.

Linking audio or visual representation of an asset, zone, component, or any combination thereof to record of an individual defect.

Tracking or recording as part of the inspection record the operator's physical proximity to the asset, zone, component, or condition throughout their inspection record.

Illustrating the operator's physical proximity to the asset, zone, component, or condition on the visual representation of such as part of an electronic DVIR solution.

Accordingly, no context switching is necessary. A user can consume the data of the zone location and enter their inspection information in the same place, rather than switching between a picture and a form.

FIG. 1 depicts an example graphical user interface for electronic daily vehicle inspection report (eDVIR) mobile app.

Figure 2:
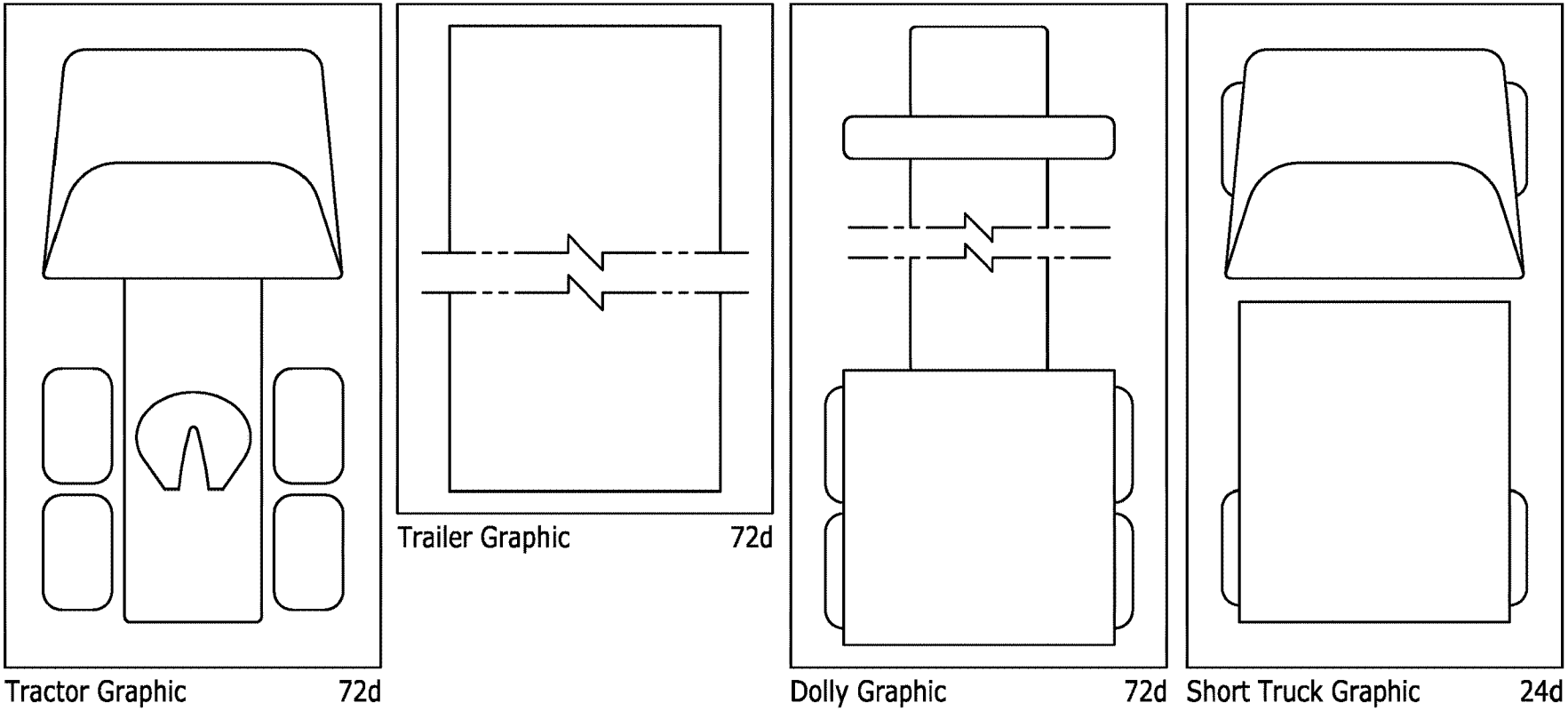
FIG. 2 depicts asset view graphics of different vehicle types.

FIG. 2 depicts asset view graphics of different vehicle types. These are examples of the images used to overlay icons that represent the physical locations of inspection zones on an asset.

Figure 3A:
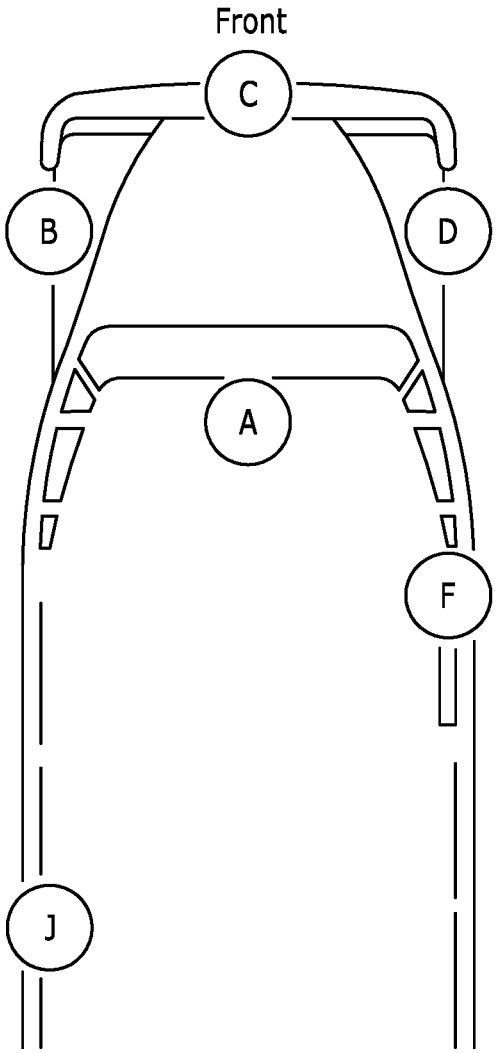
FIGS. 3*a* and 3*b* depict visual indicators of zones on an asset.
Figure 3B:
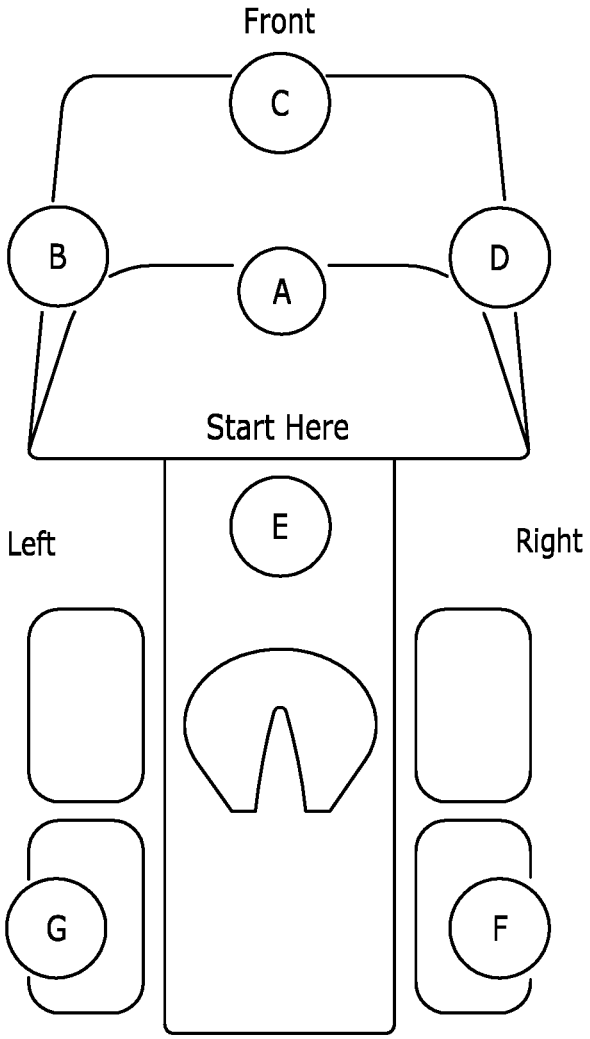

FIGS. 3*a* and 3*b* depict visual indicators of zones on an asset: This shows how icons can be overlaid on the Asset View graphics to guide the drivers to the correct physical areas of the asset.

Figure 4:
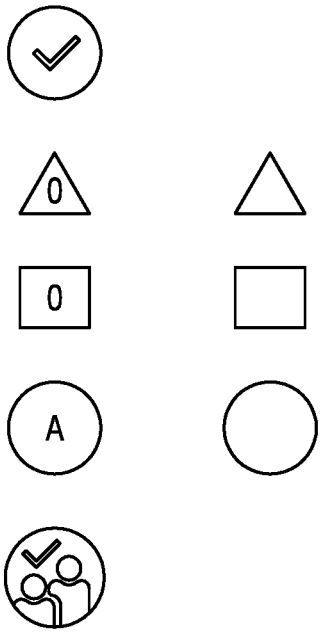
FIG. 4 depicts an example of visual representation icons used to demarcate the zone or component in a physical area of the asset, and/or link a zone or component to defects of varying severities.

FIG. 4 depicts an example of visual representation icons used to demarcate the zone or component in a physical area of the asset, and/or link a zone or component to defects of varying severities: This shows an in-progress inspection on the map view. As the zones are inspected, they are replaced with icons to indicate their condition and the number of defects present in each. This helps motor carriers to better visualize which parts of their vehicle are the largest safety risks.

Figure 5:
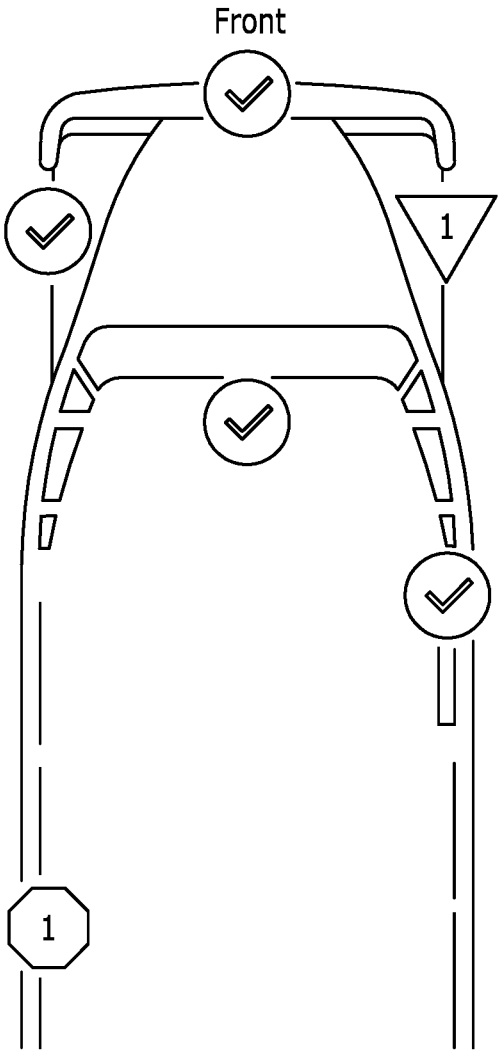
FIG. 5 depicts an example of visual representations of zones, conditions, defects, and defect properties (i.e. number, severity) applied to a visual representation of the asset.

FIG. 5 depicts an example of visual representations of zones, conditions, defects, and defect properties (i.e. number, severity) applied to a visual representation of the asset. Examples of icons already used to overlay the asset graphics. This is not an exhaustive set; additional icons may also be used.

Figure 6:
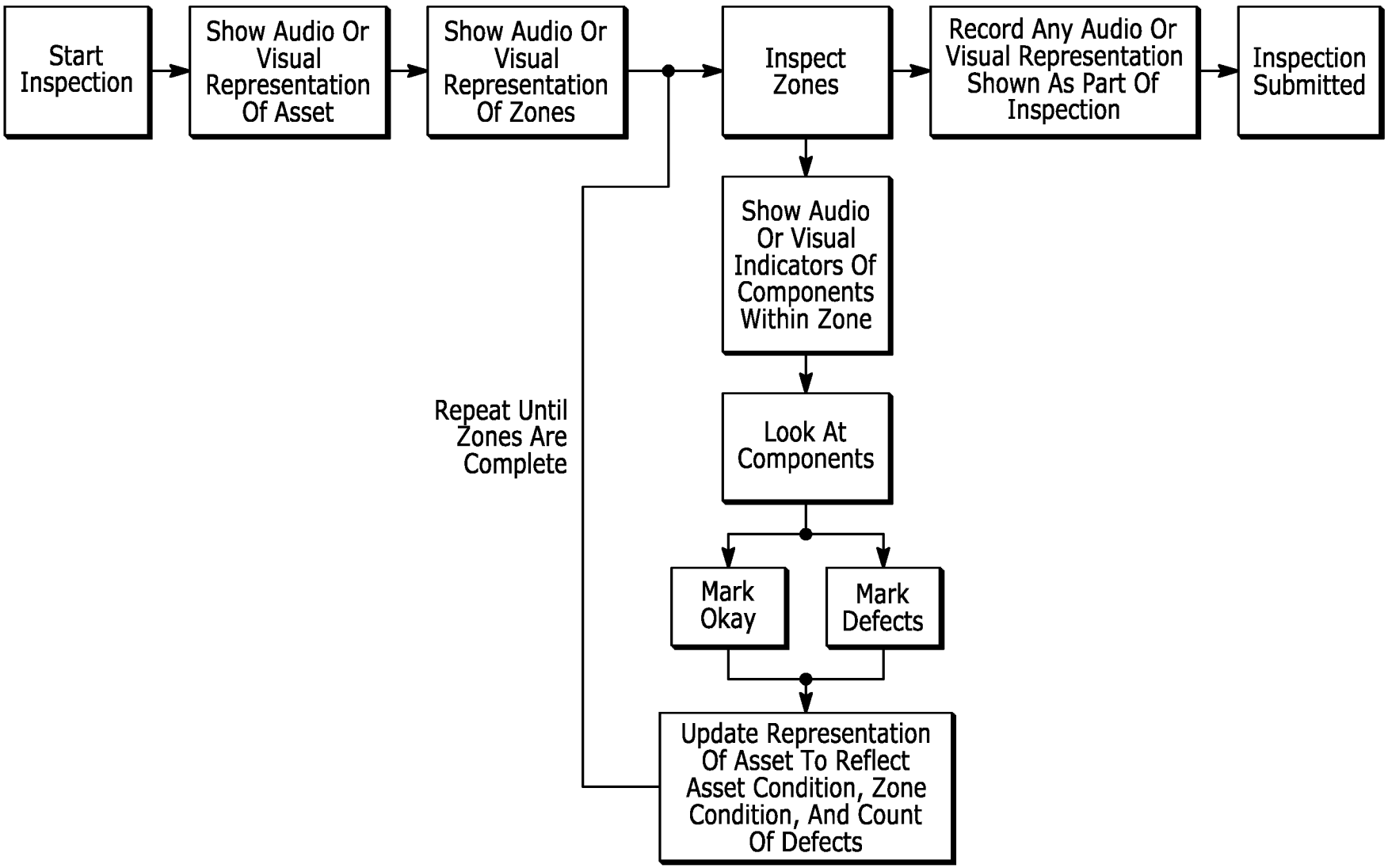
FIG. 6 depicts steps for using audio or visual indicators of assets, zones, components, conditions, and defect counts within an inspection.

FIG. 6 depicts steps for using audio or visual indicators of assets, zones, components, conditions, and defect counts within an inspection. Linking audio or visual representations of assets, zones, components, or any combinations thereof to the inspection record: Diagram which indicates where audio or visual inspection guidance would be used in the inspection workflow, and where the unique claim of recording guidance would occur in the inspection workflow if saved as a part of the overall inspection.

Figure 7:
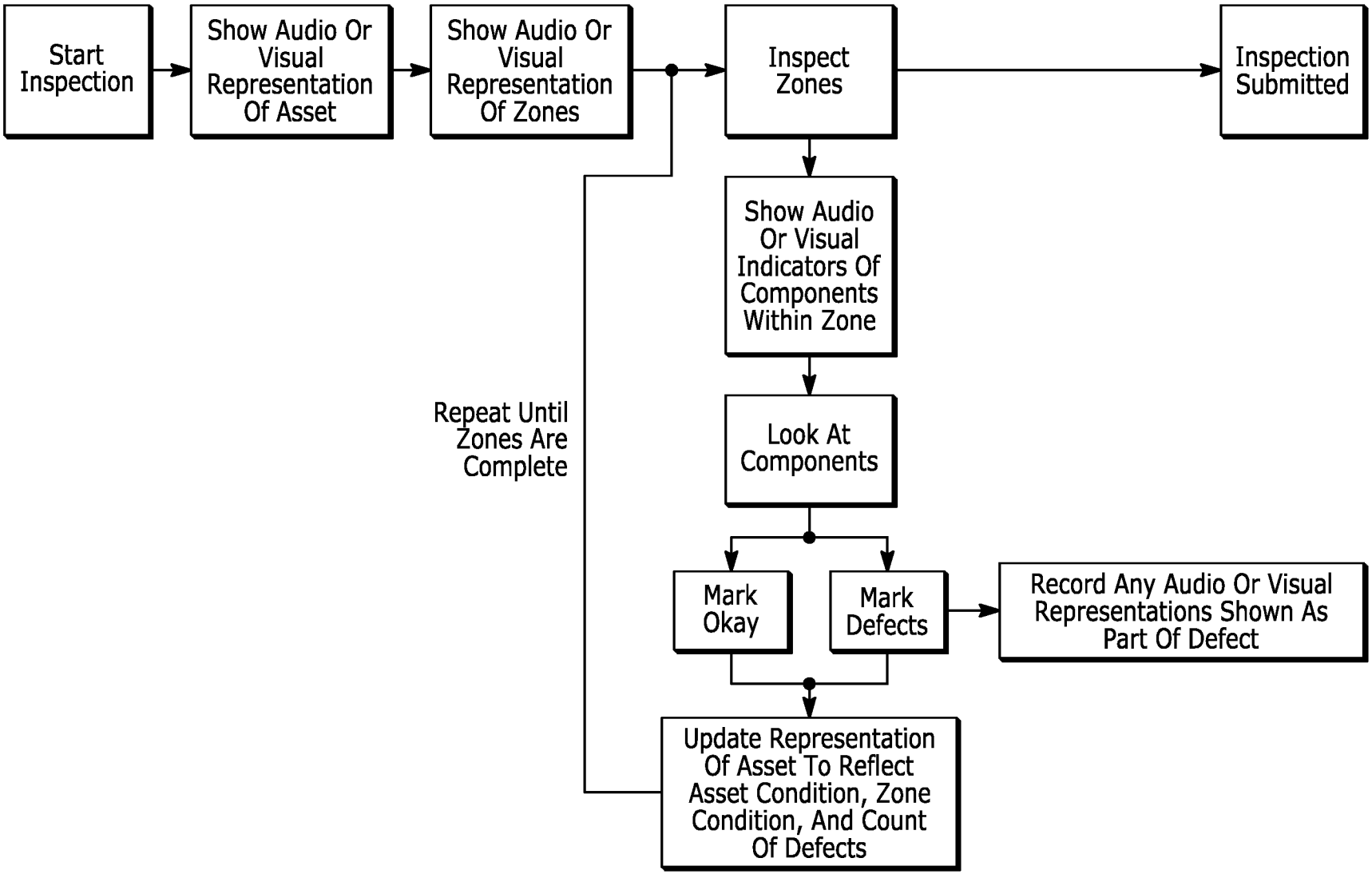
FIG. 7 depicts steps for linking audio or visual representation of an asset, zone, component, or any combination thereof to record of an individual defect.

FIG. 7 depicts steps for linking audio or visual representation of an asset, zone, component, or any combination thereof to record of an individual defect: Diagram which indicates where the unique claim of recording guidance would occur in the inspection workflow if saved as part of individual defects.

Figure 8:
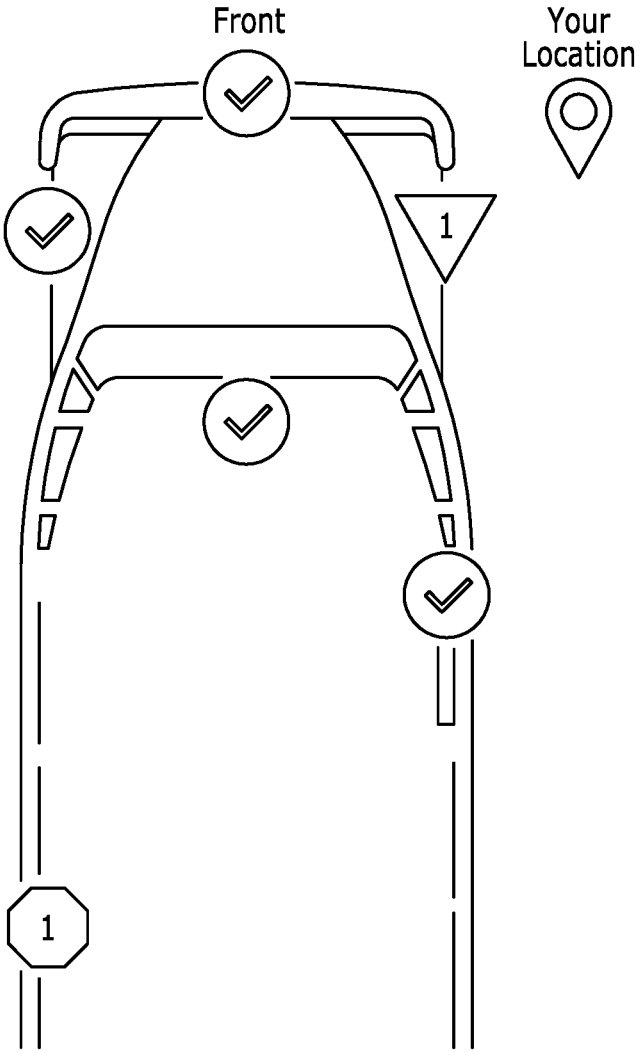
FIG. 8 depicts an example of an indication of a driver's location in proximity to visual representation of the asset during inspection.

FIG. 8 depicts an example of an indication of a driver's location in proximity to visual representation of the asset during inspection.

Figure 9:
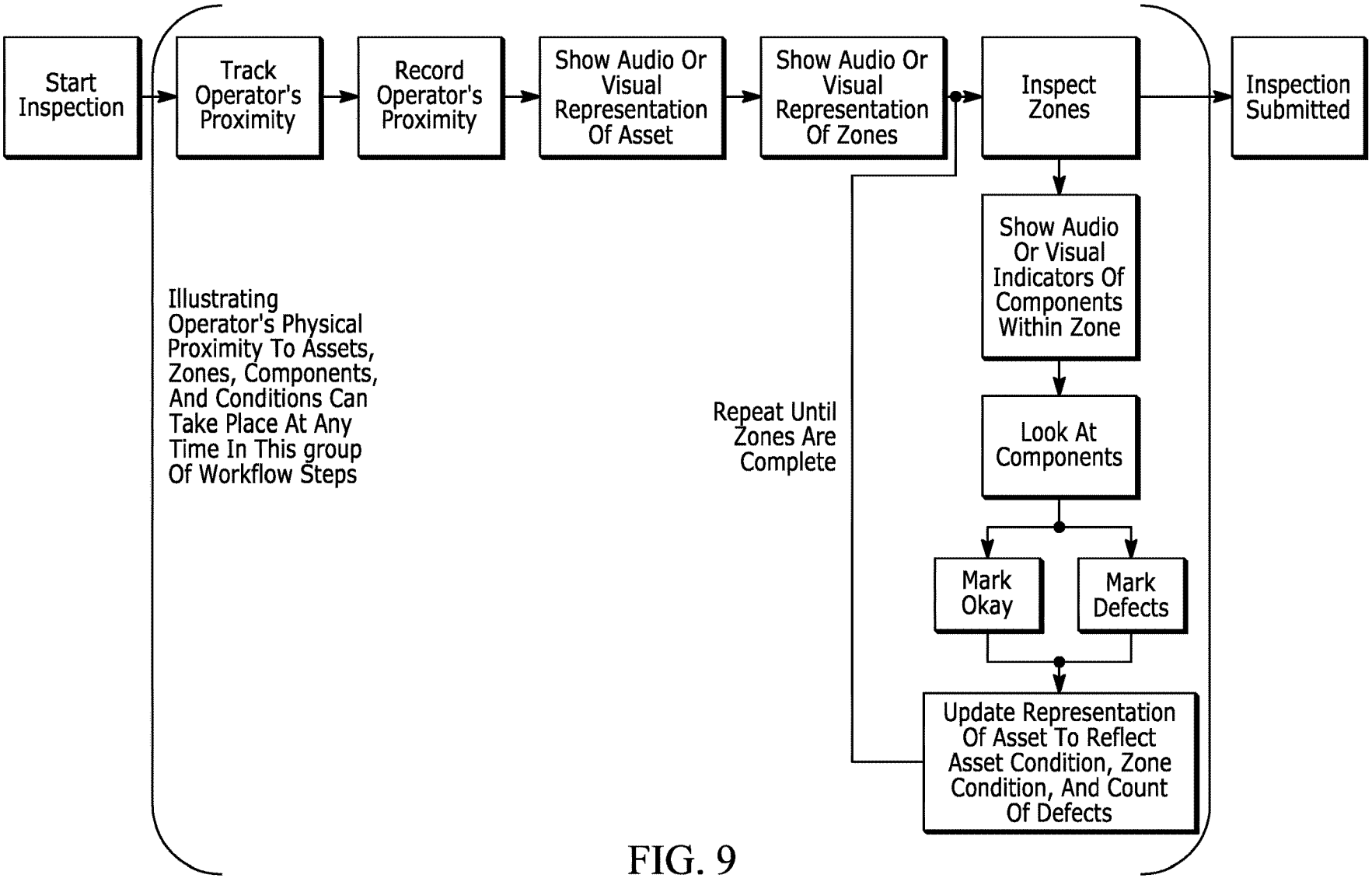
FIG. 9 depicts steps for tracking, recording, and/or illustrating as part of the inspection record the operator's physical proximity to the asset, zone, component, or condition throughout their inspection record.

FIG. 9 depicts steps for tracking, recording, and/or illustrating as part of the inspection record the operator's physical proximity to the asset, zone, component, or condition throughout their inspection record: Diagram indicating at which points in the inspection workflow the operator's physical proximity to the asset can be tracked, recorded, and illustrated.

Figure 10:
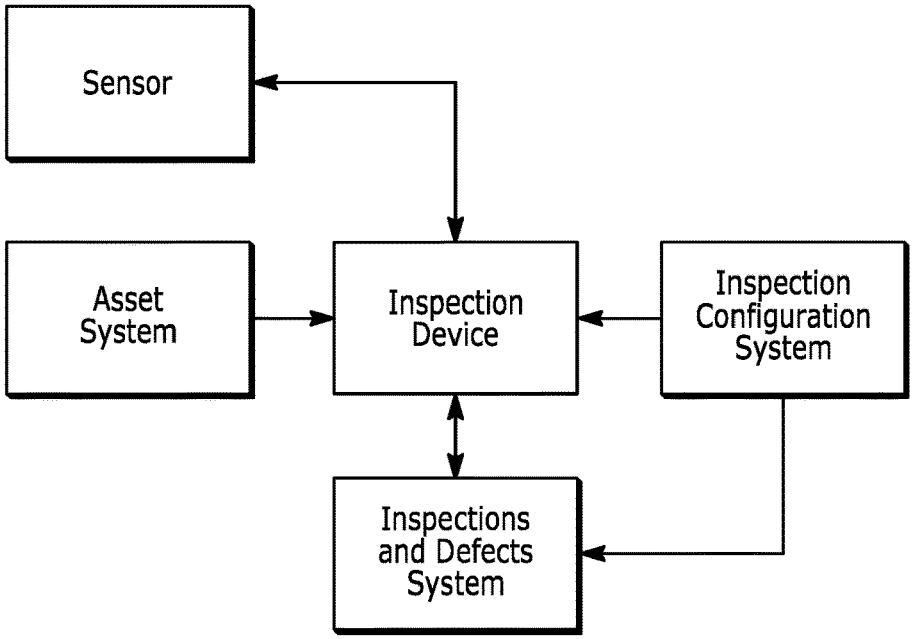
FIG. 10 is a schematic diagram showing how data is transmitted to and from the inspection device.

FIG. 10 is a schematic diagram showing how data is transmitted to and from the inspection device.

Dwell Time

Embodiments of the invention allow motor carriers to set and enforce configurable inspection time thresholds. This essentially prevents a user from advancing to the next inspection task until the minimum time threshold is met, at least in the sense that advancing too soon between inspection tasks will result in an inspection report that indicates that sufficient time was not spent on particular inspection tasks. Time thresholds can be set per inspection zone by fleet management or recommended from a fleet management supplier, such as Zonar Systems, Inc. of Seattle, Wash., based on statistical data from the tool and user-based metrics. Alerts will occur when data falls outside of norms or minimum time consistently used or other similar statistical calculations.

Embodiments of the invention are directed to how analysis and reporting of time spent within and between inspection areas of an asset, also known as a Dwell-Time Report, can be used to detect falsified inspection reports and improve inspection accuracy and efficiency.

A "Dwell Time" report, which analyzes multiple aspects of inspection duration, such as overall duration, time spent inspecting individual zones, and time spent between inspecting individual zones, may be generated. Generation of such a report may be accompanied by features on the inspection device that can communicate and enforce thresholds to make sure that that operators spend the appropriate time in each inspection zone.

This helps improves the quality of the inspection and solves the issue of motor carriers spending additional time or money on data analysis to discover artificial inflation times, who these are attributed to, and whether these are patterns that need to be addressed, by surfacing this directly (i.e., explicitly expressing it) in a report format.

A. Inspection Zone: Baseline Viewstate

Shows location of the zone relative to the vehicle asset, amount of time spent by the operator at that zone, and whether or not the time spent falls within the pre-defined time window for that zone. Certain inspection zones will also have a visual indicator that signifies them as PATH-START or PATH-END (see H below).

B. Travel Between Zones: Baseline Viewstate

Shows direction of operator travel, amount of time spent by the operator in between zones, and whether or not the time spent falls within the pre-defined time window for that travel time.

C. Inspection Zone: Time-Window Deviation

If operator exceeds the maximum allowable time in a zone, the zone indicator changes to red and an hourglass icon appears above the timestamp. This state-change also applies if operator spends less than the minimum required time to inspect that zone.

D. Travel Between Zones: Travel-Path Deviation

Shows if operator chose to inspect the vehicle zones in a different sequence than recommended or required (as represented here by the blue dashed line and directional arrow). Depending upon company policy, this deviation could be shown as a solid yellow/red path and directional arrow, indicating the contextual severity of the deviation.

E. Travel Between Zones: Time-Window Deviation

If operator exceeds the maximum allowable travel-time between inspection zones, the state of the zone indicator changes to red and an hourglass icon appears next to the timestamp. This state-change also applies if operator spends less than the minimum required time to travel between zones (shown at left on the schoolbus inspection path, indicating that the operator did not spend enough time inspecting the passenger compartment of the schoolbus in order to qualify as a compliant child-safety check). The operator would have the option to add comments to any travel-path, and provide an explanation of mitigating circumstances related to the compliance deviation.

F. Inspection Zone: Skipped/No Data

If the operator skips an inspection zone, the state of the indicator changes to red and is marked with an X. The deviation from ideal travel-path is also shown in conjunction (see E above). If technical issues prevented the system from capturing dwell-time data related to that zone, the indicator changes to yellow and is marked with a question mark.

G. Inspection Zone: Path-Start/Path-End

Certain inspection zones will have a visual indicator that signifies them as PATH-START or PATH-END. If compliance rules for the company require the operator to perform a "round-trip" inspection—i.e. start and end the inspection in the same zone—that can also be accounted for (shown at left on the school bus inspection path).

H. Inspection Zone: Special

Some zones are uniquely represented within the inspection, as is the case with the on-board child-safety check for school buses. In this example scenario, the important information is not the dwell-time at the zone itself—as the only action for the operator with that zone tag is to scan it and continue the child=safety check—the key dwell-time for this is represented by the travel-paths. As shown, this would be considered a safety/compliance violation, as the time spent between zones is significantly less than the minimum required to conduct a compliant child-safety check.

Embodiments of the invention provide: enforcement of minimum time spent in each zone with ability for fleet management to customize thresholds; a report showing duration of time spent in overall inspection, time spent inspecting individual or multiple zones, and time spent between inspecting individual or multiple zones across all DVIR inspections for a motor carrier; calculation and indication of abnormal data, or suspicious activity in above report that would indicate potential falsification of inspection records; calculation and indication of data outliers in above report that would indicate training issues or potential falsification of inspection records; alerts to motor carrier when inspections are submitted that contain violation of inspection, zone, or between-zone thresholds; passive indication to operators of inspection, zone, or between-zone thresholds set manually by the motor carrier or automatically by the electronic DVIR solution; collection of data from mobile inspection devices for the purpose of indicating potential falsification of inspection records, when combined with inspection, zone, or between-zone durations; option to prevent operators from continuing their inspections if time recorded for individual, multiple, or all zones is outside the time thresholds defined by motor carrier.

Embodiments of the invention advantageously ensure that a current inspection is done in an acceptable timeframe and increases probability that defects are detected and reduce labor costs and active monitoring necessary to detect falsification of inspection reports.

Use Cases

Report of Time Spent Within and Between Zones

The Dwell Time report will show a summary of overall inspection duration, duration of time spent within zones, and duration of time spent between zones for all inspections on the motor carrier's assets. These will be recorded either by live time-tracking, by calculating the difference between timestamps, or any combination of the two. The start and end events for all three duration types may be triggered by user activity within the application or internal application logic.

Data may be shown in a text, table, graphic, or illustrative format and may be exported to any known file type. Report may show all data for the motor carrier, or may be filtered to show data for assets, operators, inspection types, dates, times, locations or any other data point that is shared by multiple inspection records. The report may also include functions to allow the motor carrier to review the inspection and its' contents in further detail.

Overall inspection duration will be calculated as the sum of time spent from inspection start to inspection finish.

Duration of time spent within an individual zone is calculated from the time that the operator indicates they have begun inspecting a zone to the time they indicate they have completed inspecting the zone.

Duration of time spent between zones is calculated from the time that the operator indicates that they have completed inspecting a zone to the time that they indicate they are once again inspecting a zone. Includes:

Time between starting the inspection and inspecting the first zone

Time between inspecting the last zone and ending the inspection

Identification of Data Outliers or Suspicious Data

This report is capable of showing data across a motor carrier's entire fleet, showing trends of normal or suspicious behavior over time, and showing detailed history of asset and operator inspection activity.

The report is capable of identifying and indicating data outliers such as unusually short or long durations in comparison to time limits set for the following:

Overall Inspection Duration

Time Spent Within a Zone

Time Spent Between Inspecting Zones

Customization of Time Thresholds

Minimum and maximum duration thresholds can be set using a variety of methods.

One method is to manually set the low and high time thresholds for overall inspection duration, duration of time spent within zones, and duration of time spent between zones.

Another method is to use the mean, median, mode, and/or standard deviations of existing values for the following:

Overall inspection durations that are longer or shorter than inspection durations across inspections in the fleet, inspections completed by the same operator, or completed for the asset.

Zone inspection durations or time spent between zones that is longer or shorter than durations for other zones within the same inspection.

Zone inspection durations or time spent between zones that is longer or shorter than zone durations for other zones in inspections across the fleet, completed by the same operator, or completed for the same asset.

In this case, values outside of the "normal" calculated ranges would be flagged as abnormal, similarly to Statistical Process Control principles. If multiple calculations are available to choose from, motor carriers may choose which one of these calculations are preferred.

These thresholds will affect what the reports indicate as data outliers or potential suspicious activity.

Alert Motor Carrier

The report may require or give the motor carrier the option to receive alerts when an inspection falls outside the low or high time thresholds for any duration type. These alerts may be surfaced within the report itself or take the form of other external communications to individuals employed by the motor carrier.

Alerts may be configured to require action or dismissal, or may be read-only. Alerts may contain additional information about the inspection, operator, asset, duration, and thresholds.

Threshold Indicators and Alerts Shown to Operator

The report may be linked to the remote inspection device being used by the operator to communicate the low and high time thresholds for any duration type, and inform the operator when the inspection time has fallen outside any of these thresholds.

These alerts may be surfaced directly through the remote inspection device, through the electronic DVIR application, or through other communications to the operator. Alerts may be configured to require action or dismissal, or may be read-only. Alerts may contain additional information about the inspection, asset, exceeded threshold, or communications from the motor carrier.

The operator may also be shown a passive indicator of the low and high time thresholds for overall inspection duration, time within zones, and time between zones, even if these thresholds have not been exceeded, for the purpose of the operator being able to manage their time so as not to exceed these thresholds.

Alternately, the inspection device may also be used to actively affect the inspection process, preventing the user from taking actions during their inspection, continuing their inspection, or submitting their inspection if any durations fall outside the time thresholds set by the motor carrier.

Indicators and alerts may be communicated through text, graphics, audio, video, and/or tactile feedback to the operator.

Summary of Normal and Outlying Trends Across Fleet

The report may show to the operator and/or the motor carrier a trend summary of overall inspection duration, duration spent within zones, or duration spent between zones, where patterns of normal or outlying behavior are shown over time. The report may call out periods of outlying or suspicious behavior, as well as information about the thresholds, inspection types, and precedents that caused individual points to be considered outliers or suspicious.

These trend summaries may be presented in a text, table, graphic, or illustrative format and may be exported to any known file type. Report may show all data for the motor carrier, or may be filtered to show data for single assets, operators, inspection types, dates, times, locations or any other data point that is shared by multiple inspection records.

Collection of Information from Mobile Inspection Device to Support Reporting

Additional data may be collected from the mobile inspection device to be surfaced in the report and support determination of duration as being inside or outside the acceptable thresholds. This includes GPS location, acceleration, phone activity, and orientation, and would be used to determine if inspection activity was likely occurring within otherwise normal inspection, zone, and between-zone durations. As an example, if a zone duration is of a normal length but the mobile inspection device does not indicate that the user was actually moving, this may indicate falsification of the inspection report.

Figure 11A:
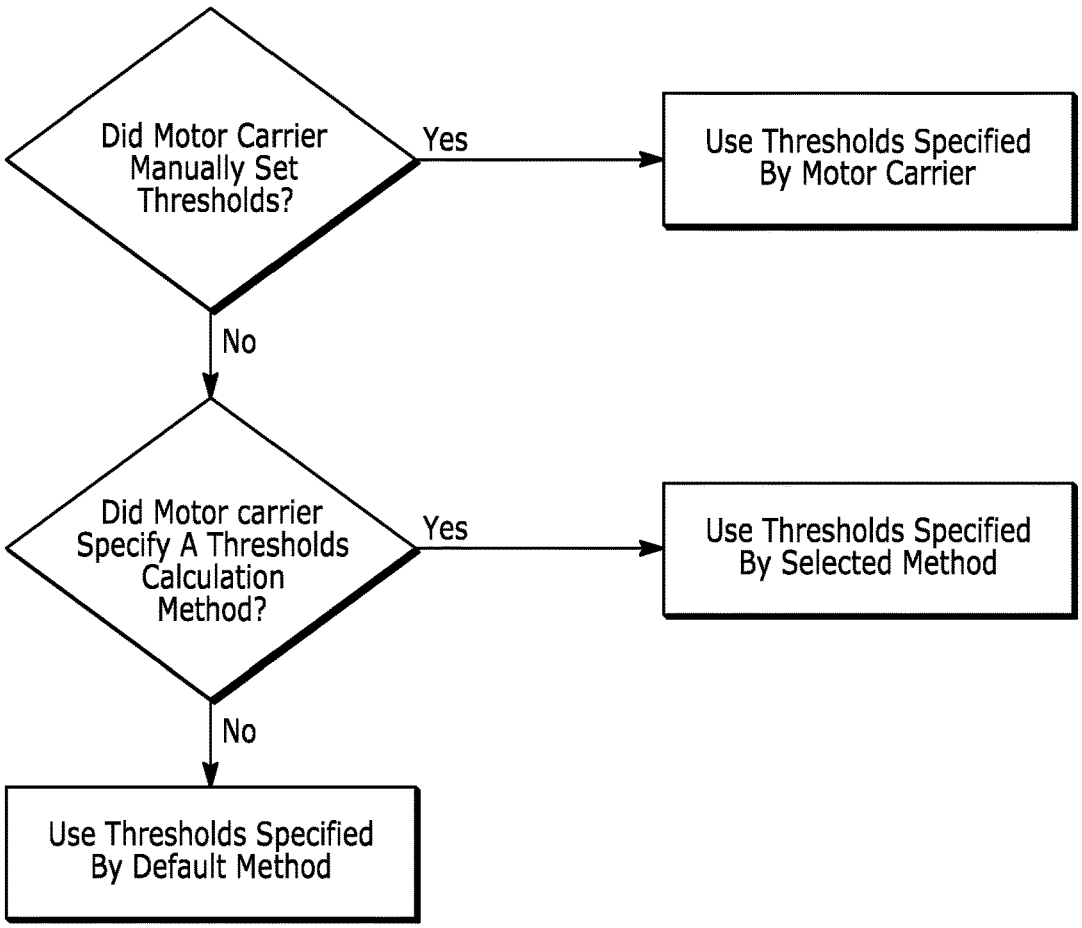
FIGS. 11A and 11B depict Logic for Identifying and Surfacing Abnormal Inspection Data in Dwell Time Report.
Figure 11B:
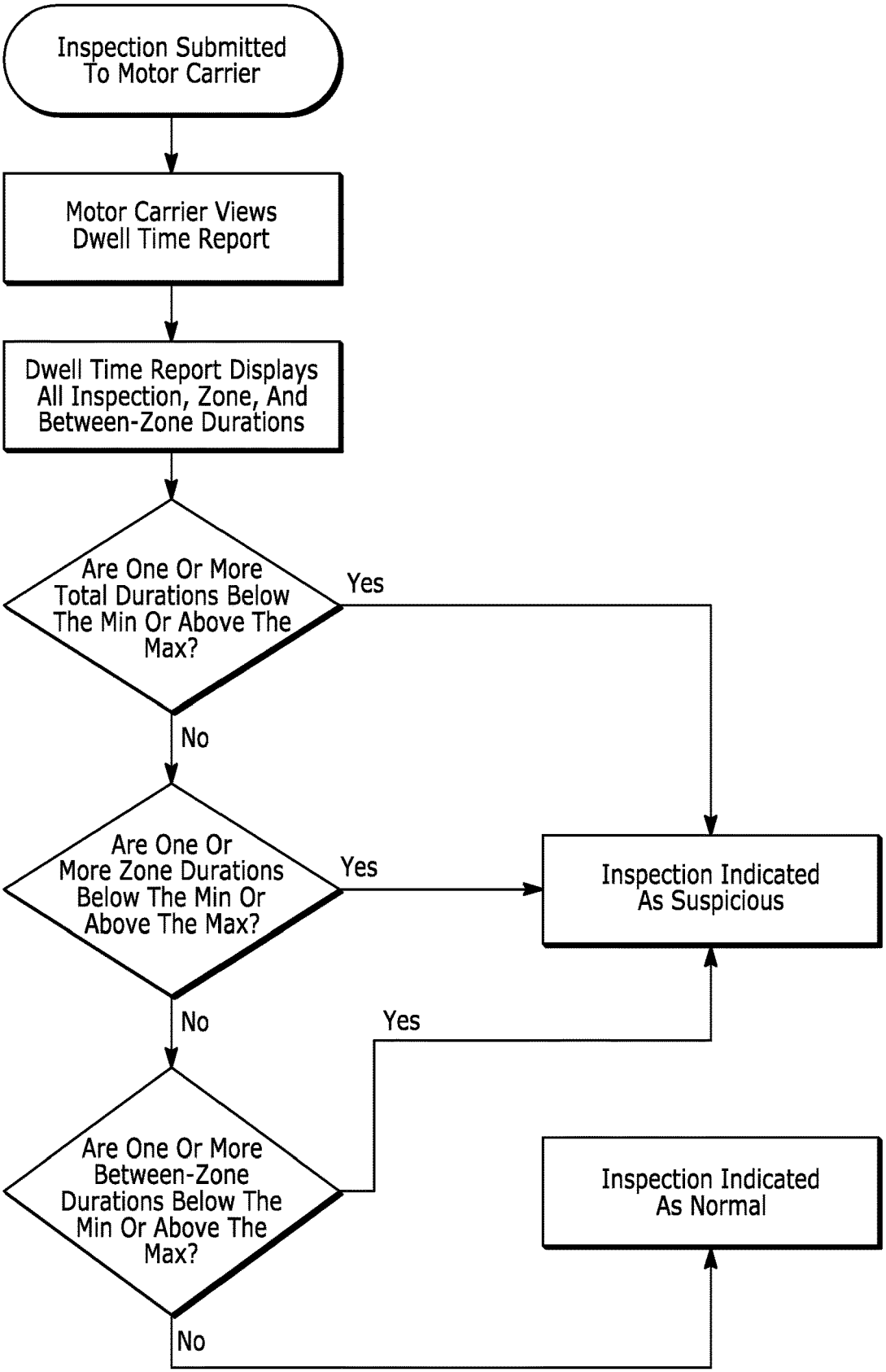

FIGS. 11A and 11B depict Logic for Identifying and Surfacing Abnormal Inspection Data in Dwell Time Report: Process used to obtain thresholds for determining abnormal inspection data and surfacing it to the motor carrier through a web or SaaS application.

Figure 12A:
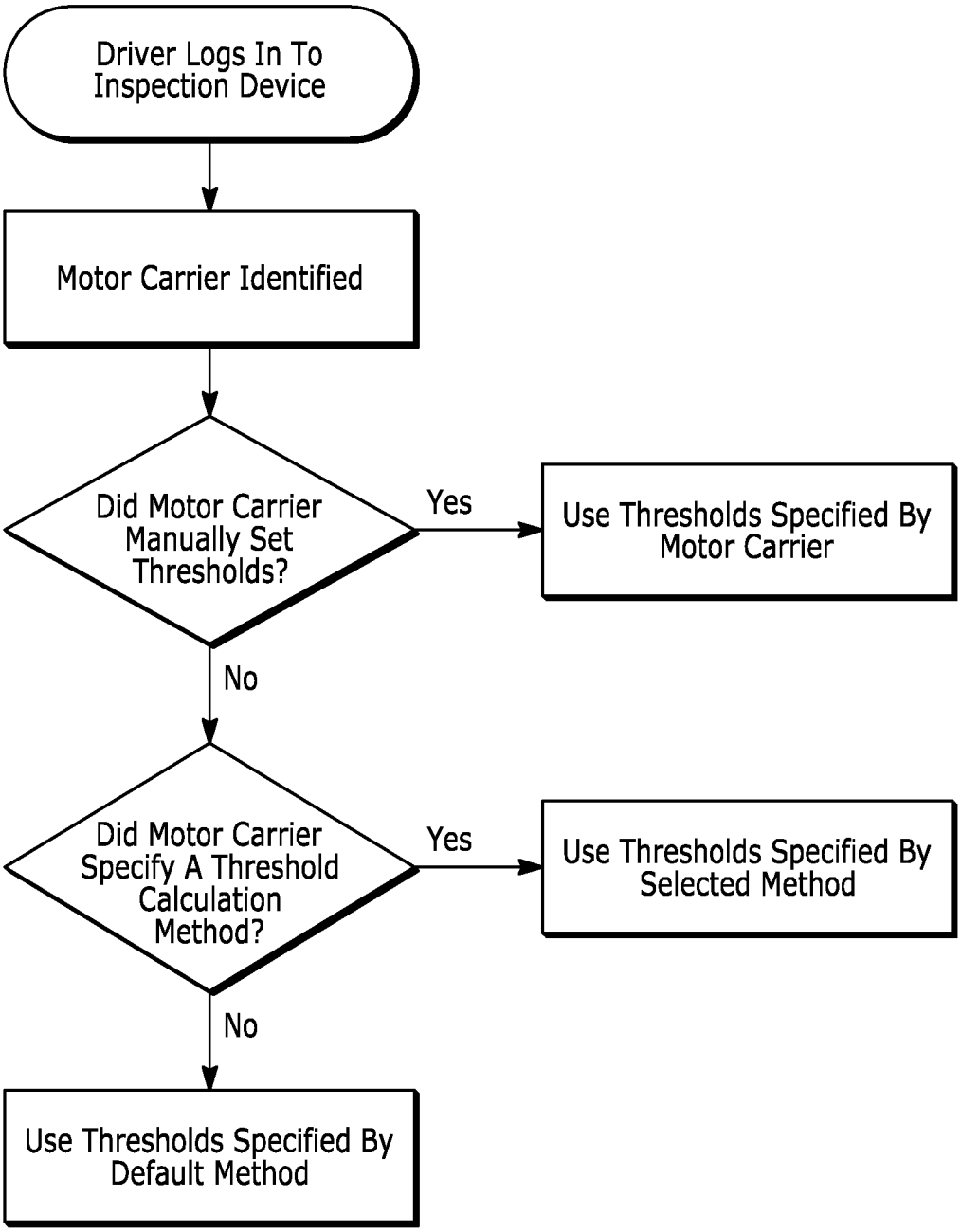
FIGS. 12A and 12B depict logic for Identifying and Surfacing Abnormal Inspection Data to the Individual Conducting the Inspection.
Figure 12B:
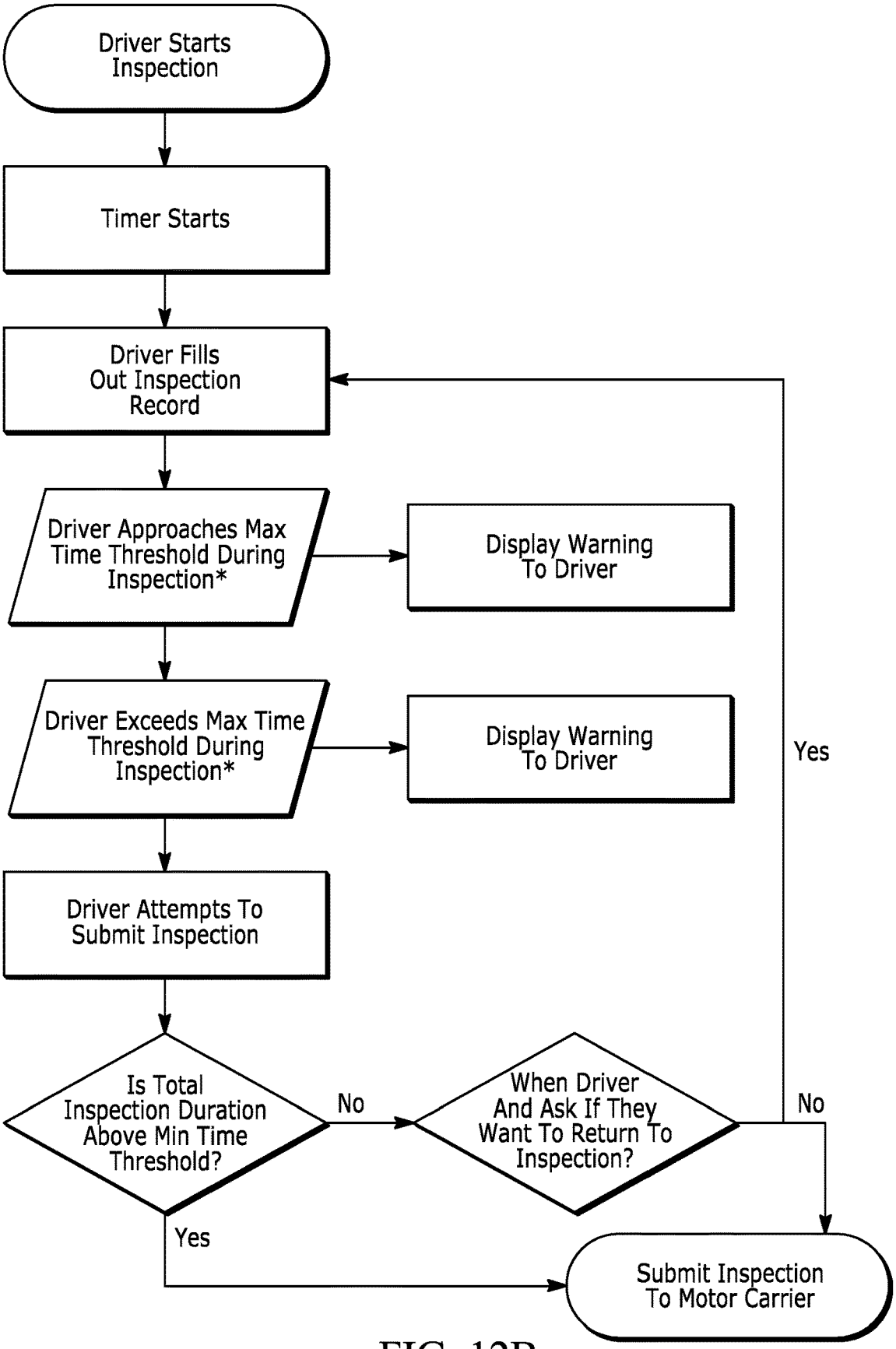

FIG. 11A depicts steps for obtaining a threshold for motor carrier for a motor carrier's view of a dwell time report FIG. 11B depicts steps for applying the thresholds of FIG. 11A to a motor carrier's view of a dwell time report FIGS. 12A and 12B depict logic for Identifying and Surfacing Abnormal Inspection Data to the Individual Conducting the Inspection: Process used to obtain thresholds for determining abnormal inspection data and surfacing it to the driver through their inspection device.

Figure 13:
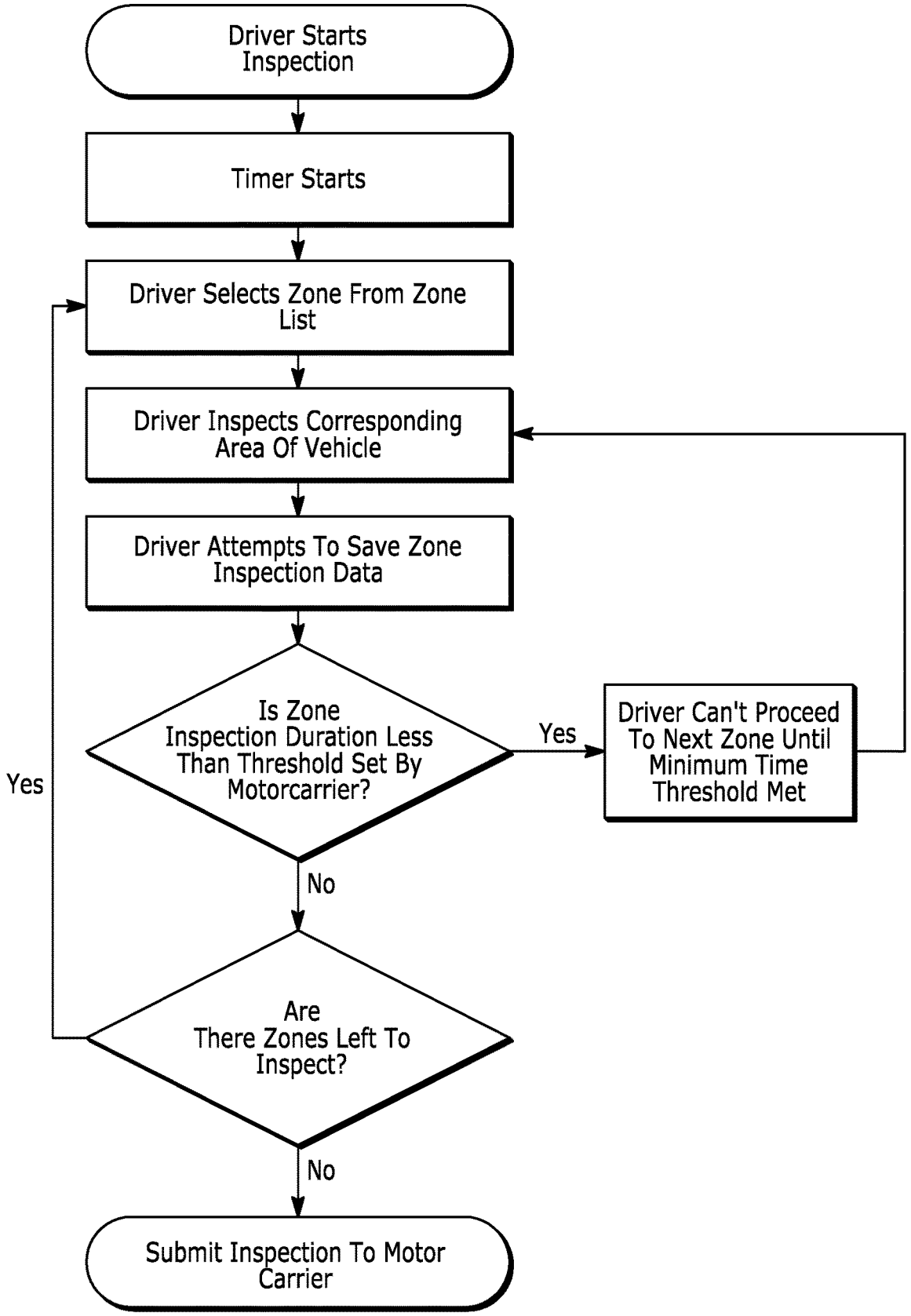
FIG. 13 depicts steps for enforcing a minimum inspection time per zone to ensure quality.
Figure 14:
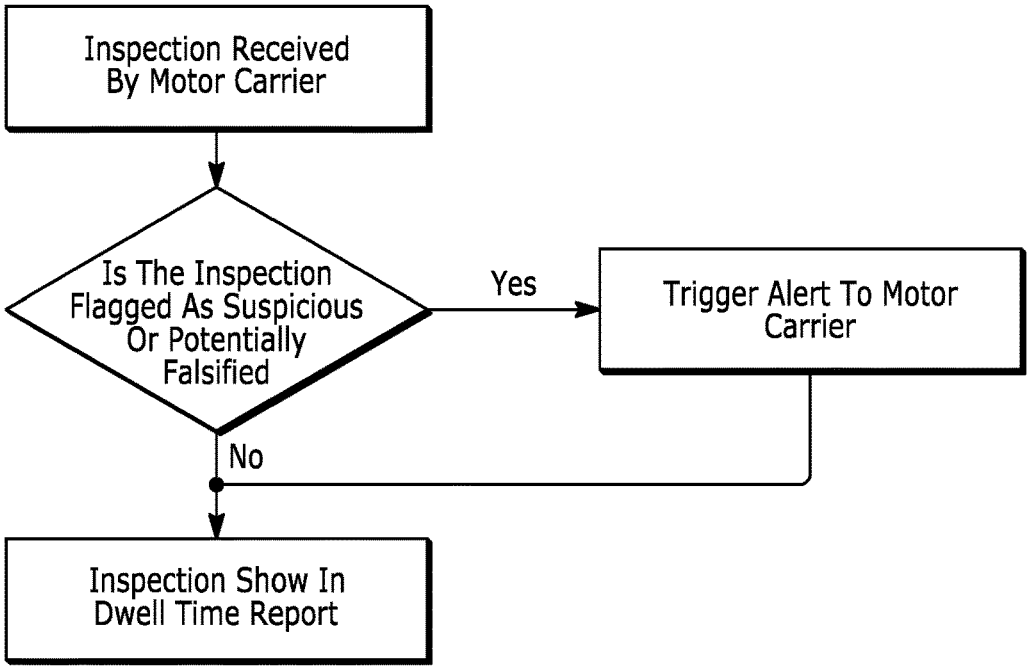
FIG. 14 depicts alerts to motor carrier when inspections are submitted that contain violation of inspection, zone, or between-zone thresholds.

FIG. 12A depicts steps for obtaining a threshold for motor carrier for a mobile-inspection device's view of a dwell time report FIG. 12B depicts steps for applying the thresholds of FIG. 12A to a mobile-inspection device's view of a dwell time report FIG. 13 depicts steps for enforcing a minimum inspection time per zone to ensure quality FIG. 14 depicts alerts to motor carrier when inspections are submitted that contain violation of inspection, zone, or between-zone thresholds. Steps are shown of a process used to determine when to alert motor carrier of abnormal inspection data.

Figure 15:
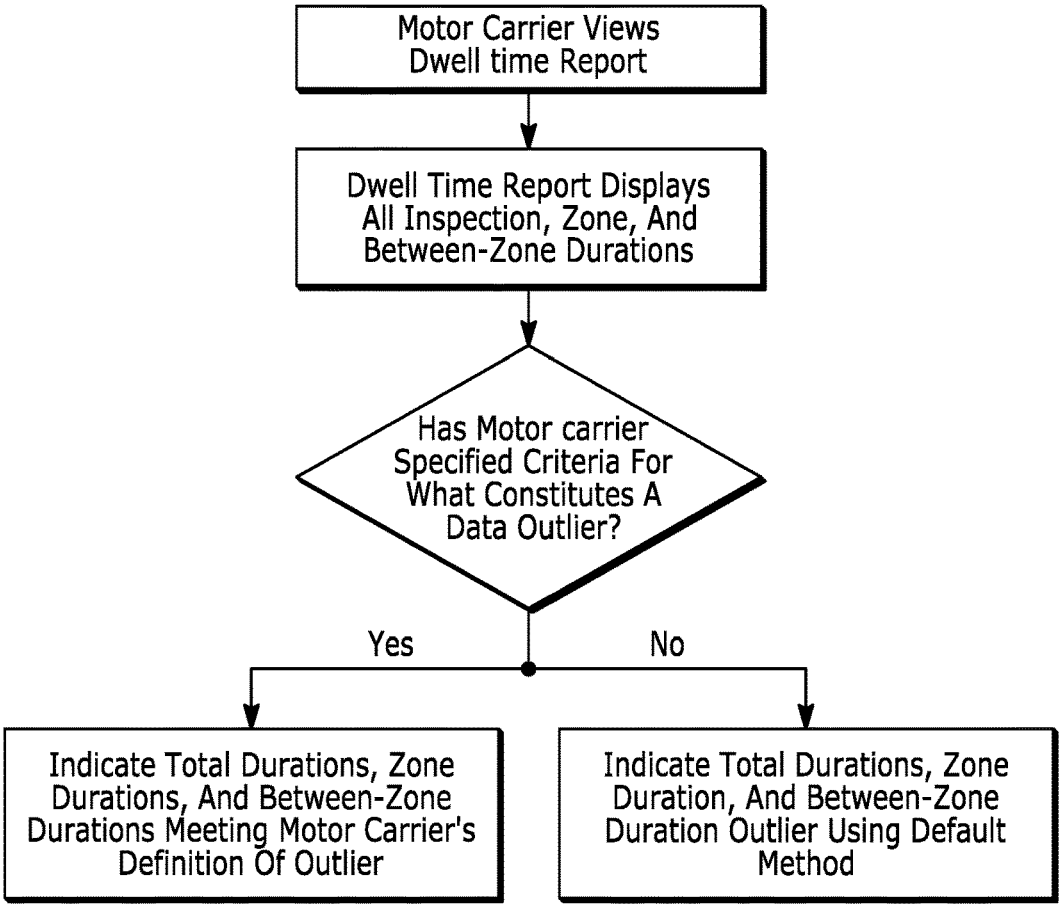
FIG. 15 depicts calculation and indication of data outliers in dwell-time report that would indicate training issues or potential falsification of inspection records.

FIG. 15 depicts calculation and indication of data outliers in dwell-time report that would indicate training issues or potential falsification of inspection records. Steps are shown of a process used to highlight abnormal data on the motor carrier's dwell-time report.

FIG. 16 depicts an example dwell-time report identifying abnormal inspection data. An example is depicted of a possible design showing how the logic of FIGS. 11A and 11B can be implemented for display to the motor carrier.

Figure 17A:
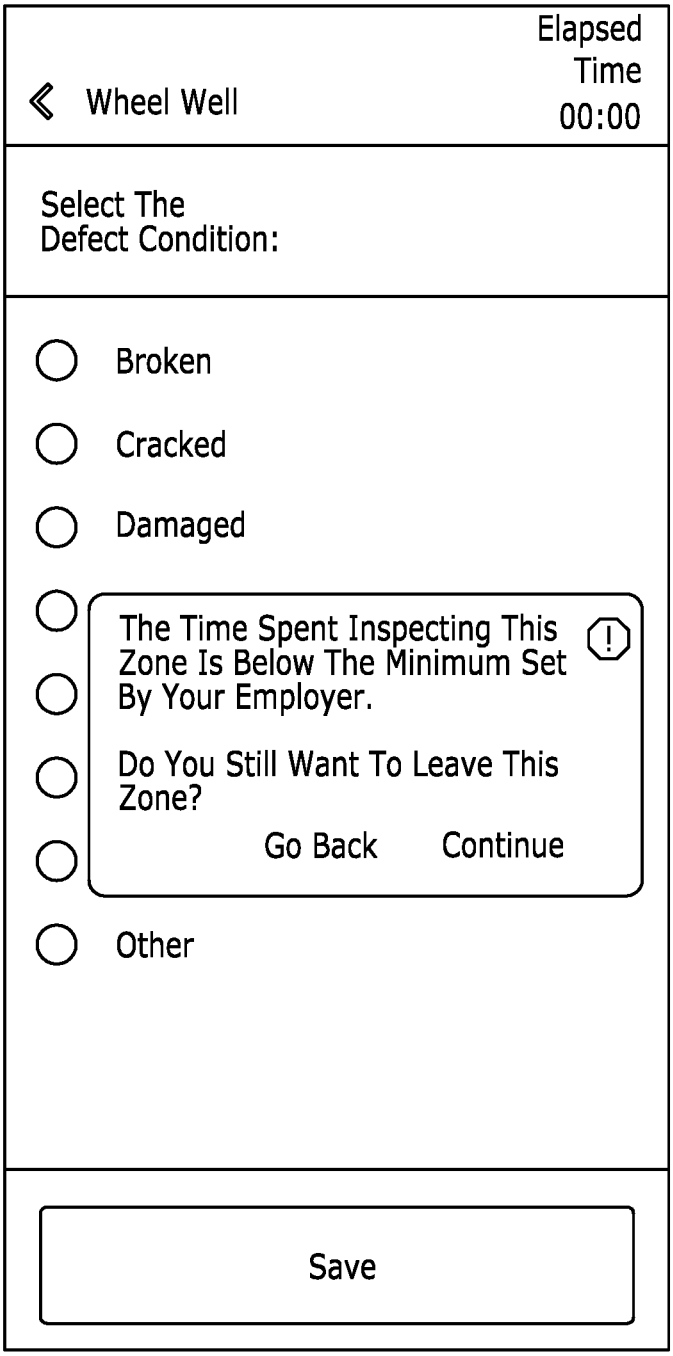
FIGS. 17A and 17B depict indications of violations of minimum and maximum zone dwell-time thresholds on a mobile device.
Figure 17B:
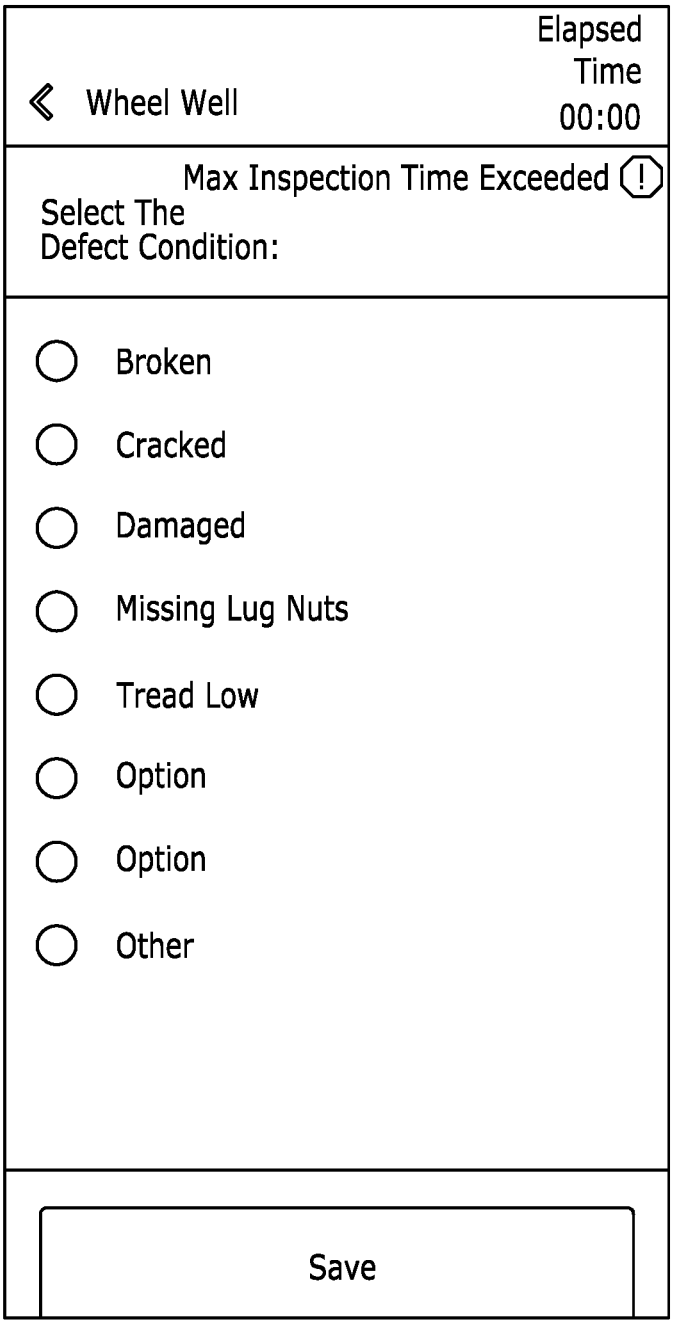

FIGS. 17A and 17B depict indications of violations of minimum and maximum zone dwell-time thresholds on a mobile device: Example of possible design showing how the logic of FIGS. 12A and 12B can be implemented on an interface shown to the operator while inspecting a zone.

Figure 18A:
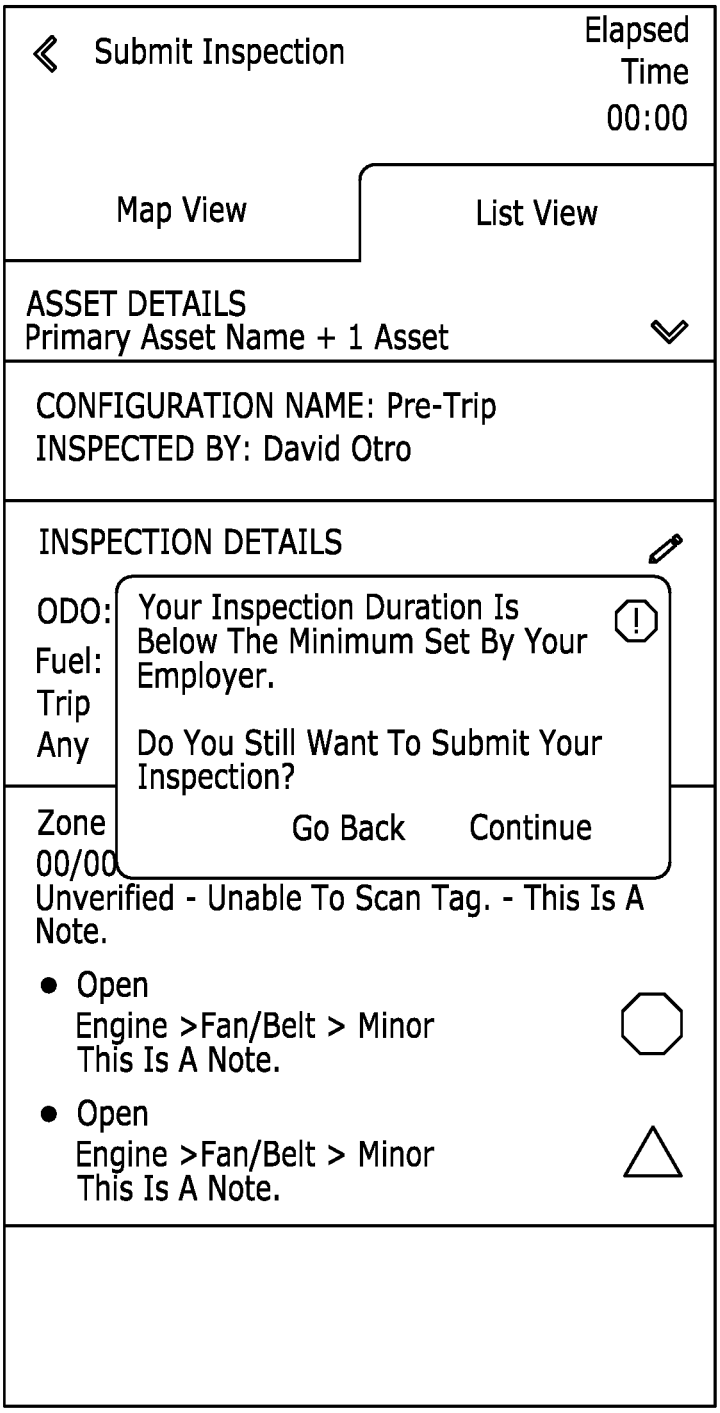
FIGS. 18A and 18B depict an indication of minimum and maximum overall inspection-time threshold to an operator.
Figure 18B:
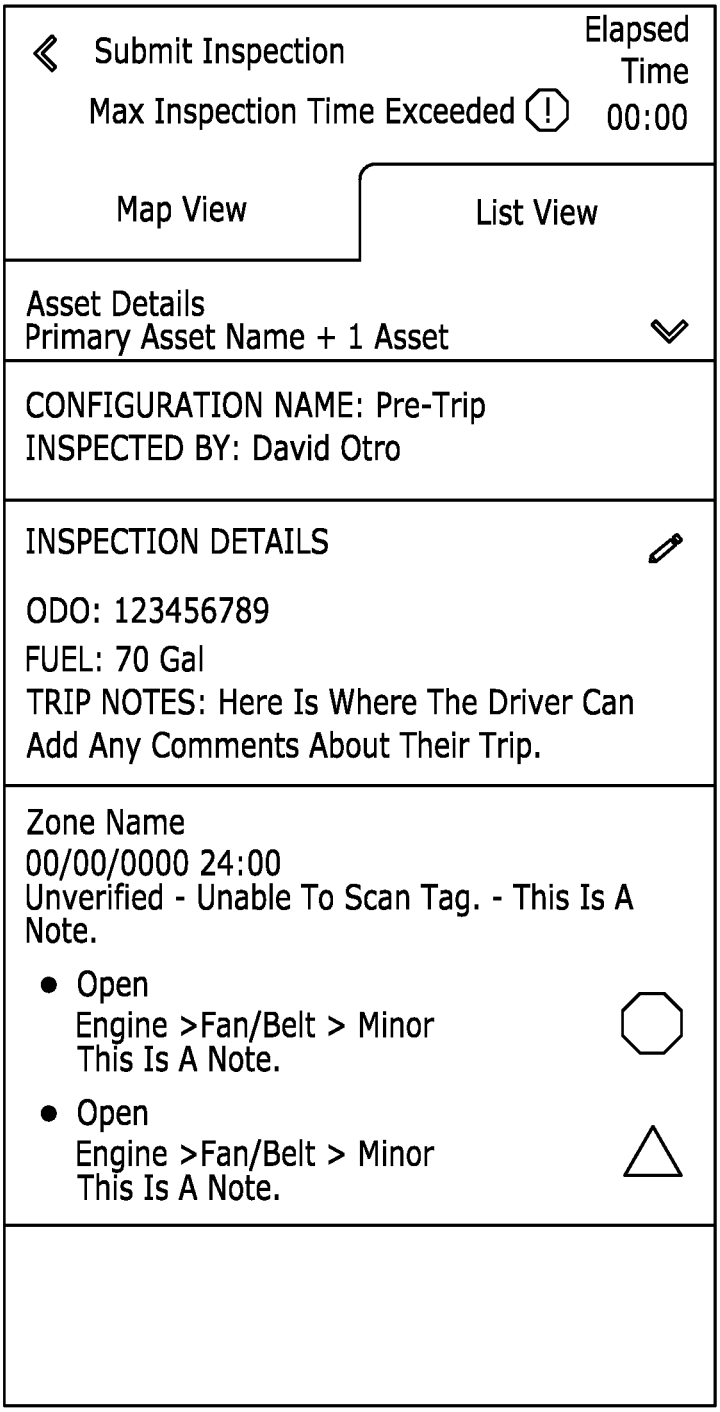

FIGS. 18A and 18B depict an indication of minimum and maximum overall inspection-time threshold to an operator: Example of possible design showing how logic of FIGS. 12A and 12B can be implemented on an interface shown to the operator for an entire inspection (more general and comprehensive than an individual zone).

Figure 19:
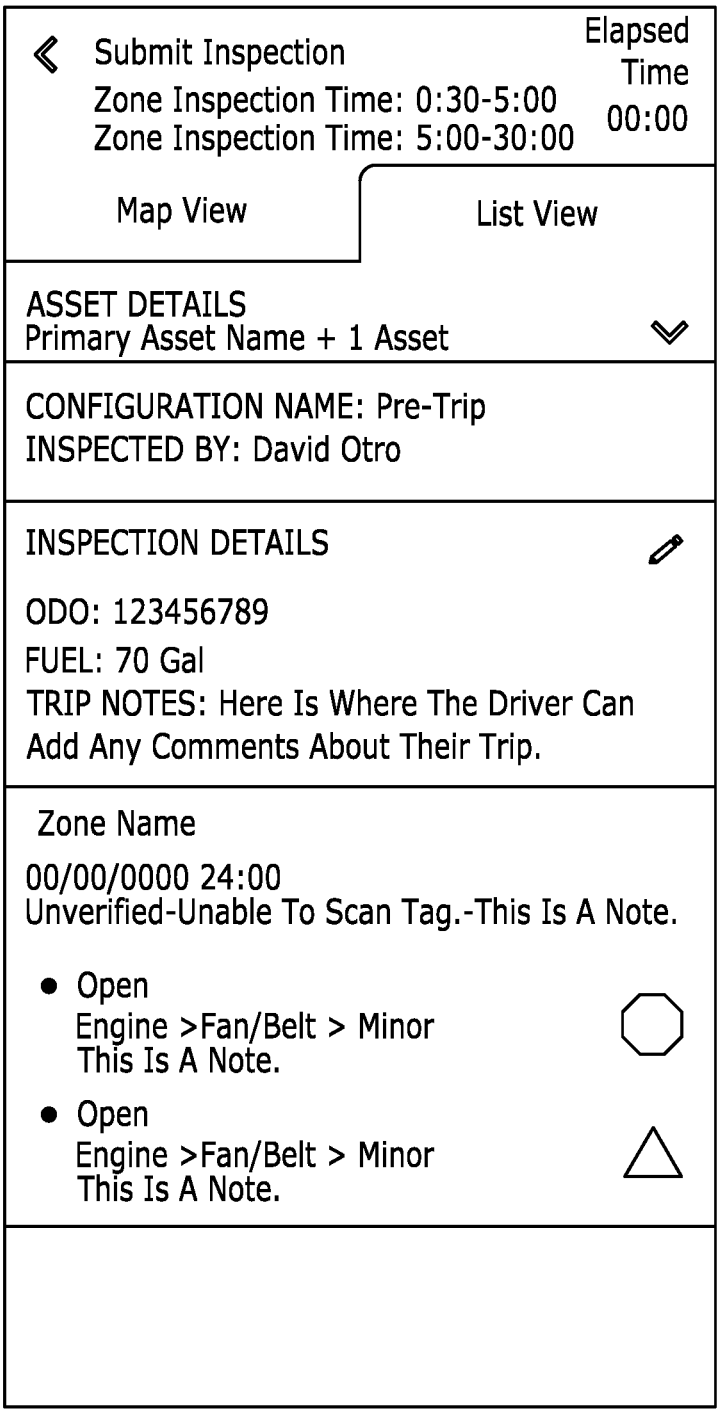
FIG. 19 depicts indicating inspection-time-limit values on a mobile device.

FIG. 19 depicts indicating inspection-time-limit values on a mobile device. An example is shown of a possible design showing how the thresholds obtained may be displayed to inspectors during their inspections.

Figure 20:
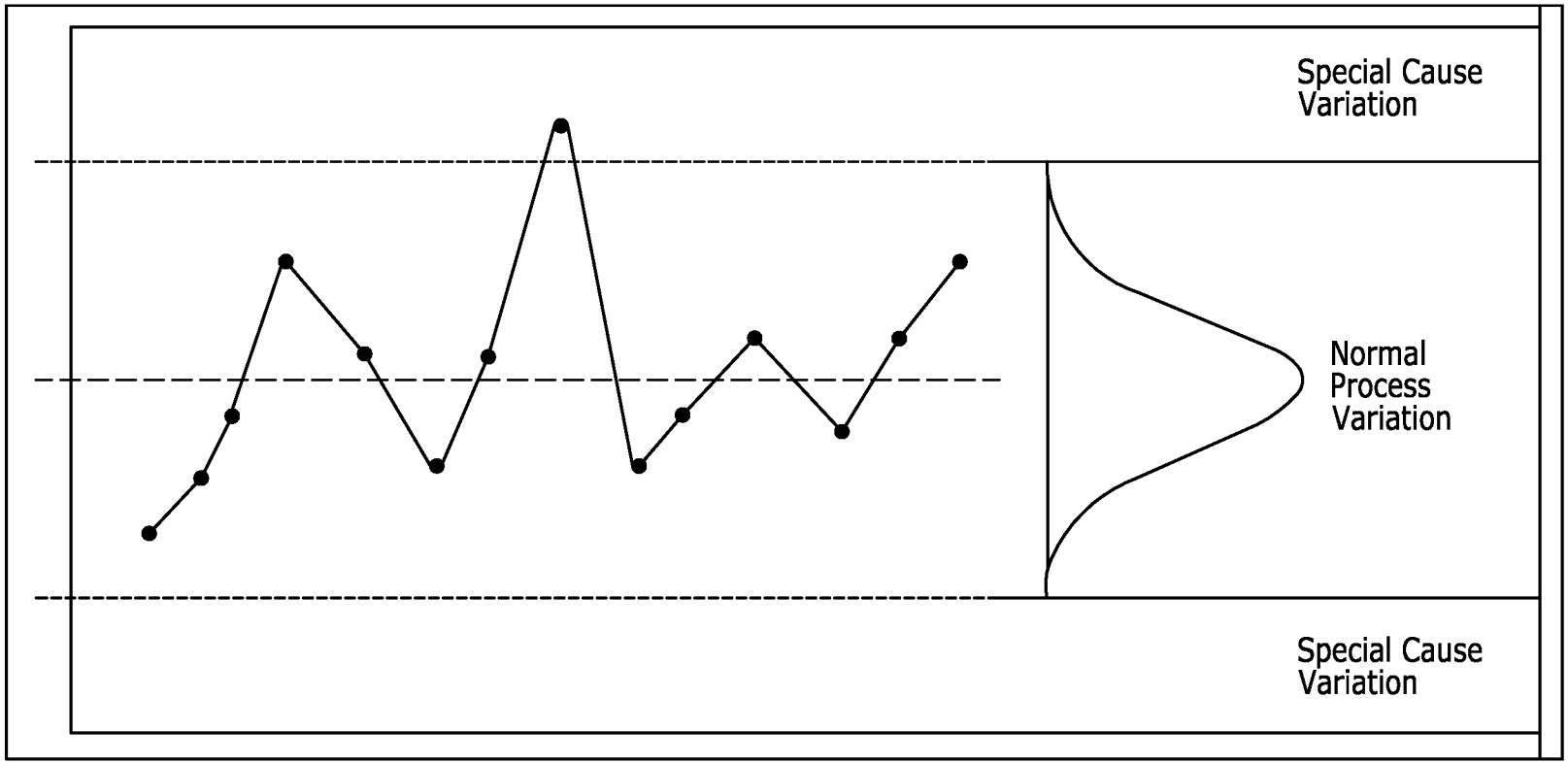
FIG. 20 depicts an example of statistical process control that may be used to identify abnormal inspection duration.
Figure 21A:
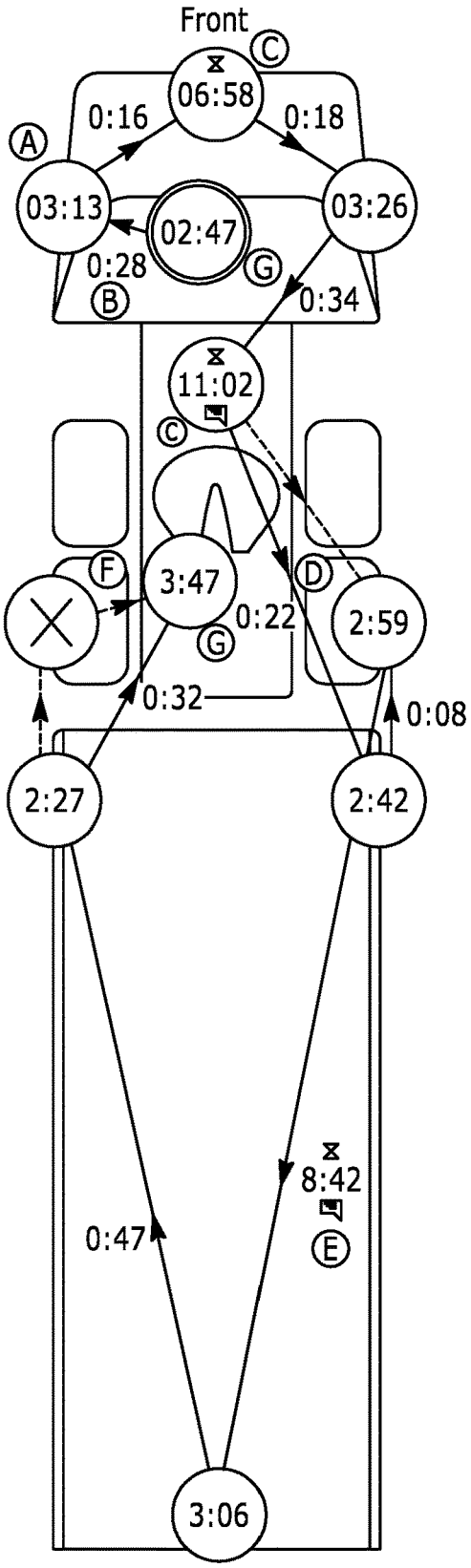
FIGS. 21A and 21B are a cartographic representation of dwell-time states and situations within a scenario context of an operator-led vehicle inspection.
Figure 21B:
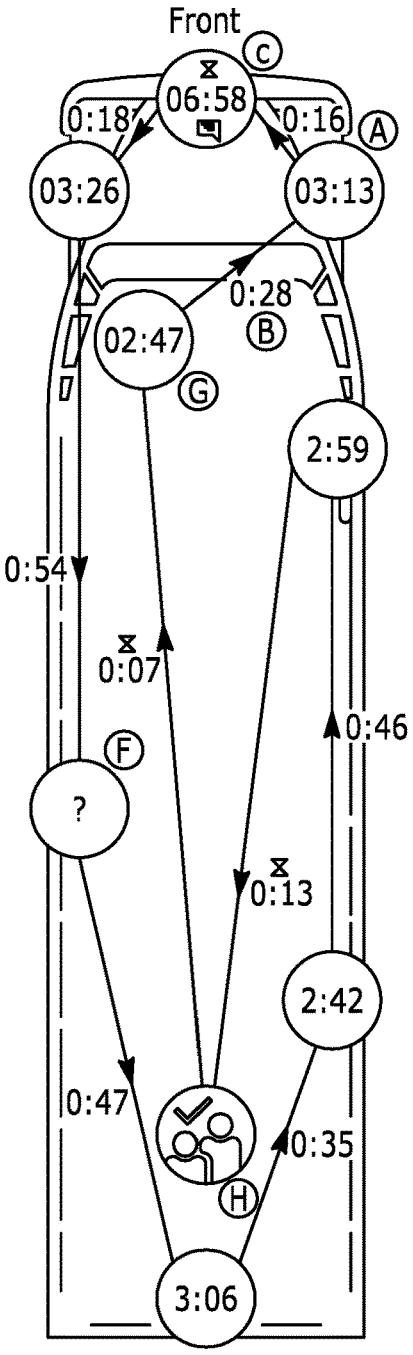

FIG. 20 depicts an example of statistical process control that may be used to identify abnormal inspection duration FIGS. 21A and 21B are a cartographic representation of dwell-time states and situations within a scenario context of an operator-led vehicle inspection. An example is shown of a possible design of a completed inspection record illustrated to show dwell-time data collected during an inspection.

Figure 22:
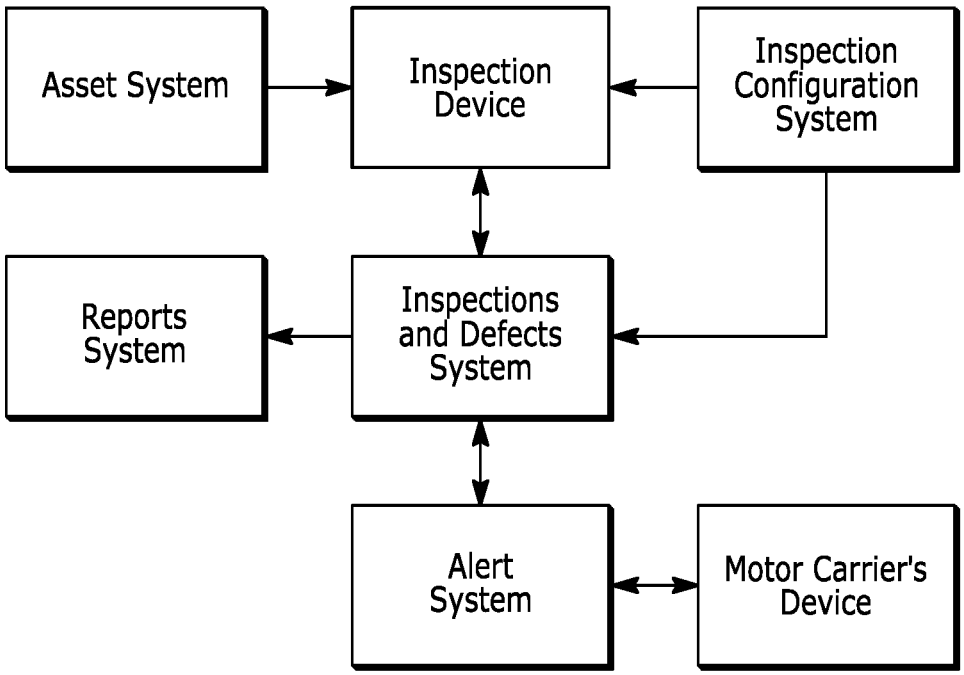
FIG. 22 is a schematic diagram depicting data flow between an inspection device and other related entities.
Figure 23A:
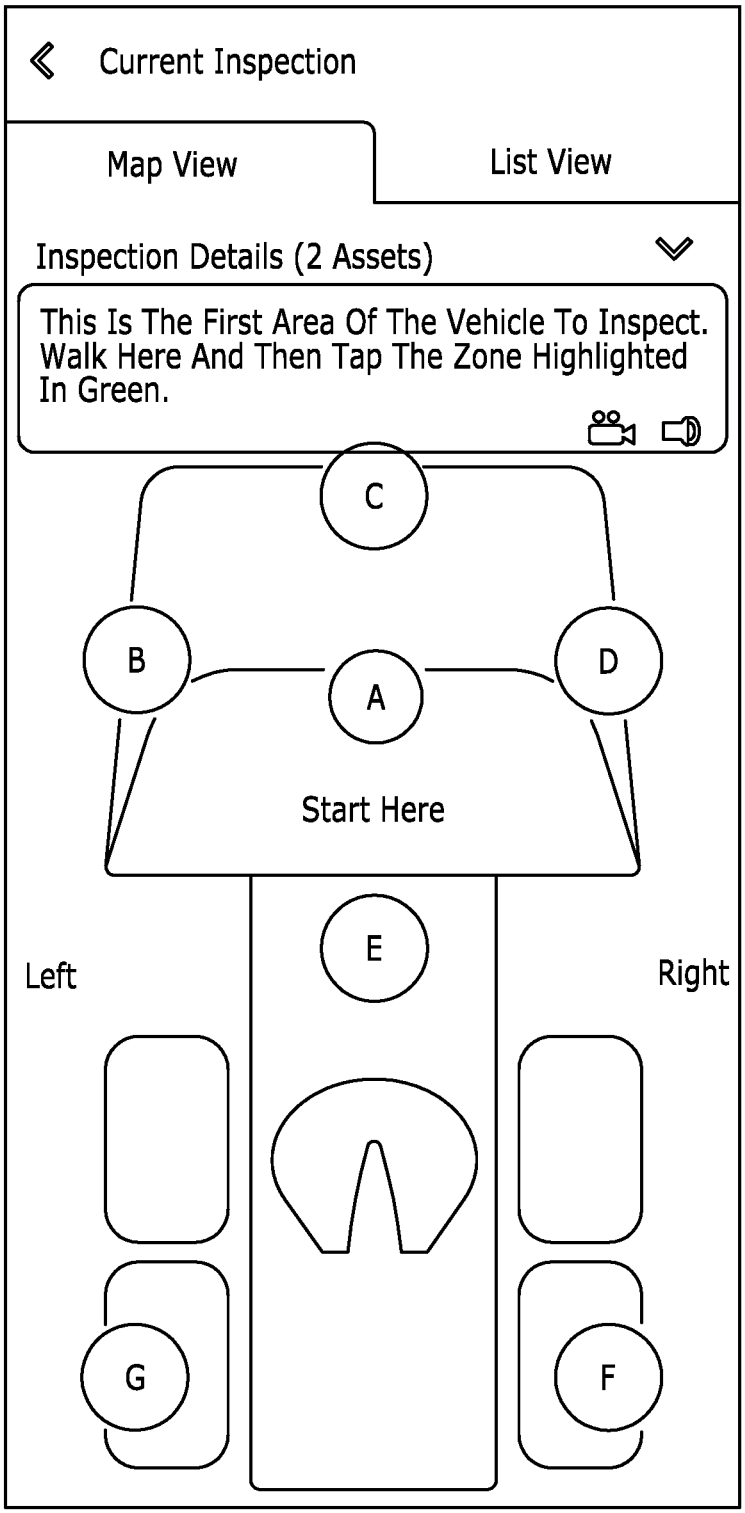
FIGS. 23A-23E depict an example implementation inspection guidance in combination with visual representation or illustration of the asset.
Figure 23B:
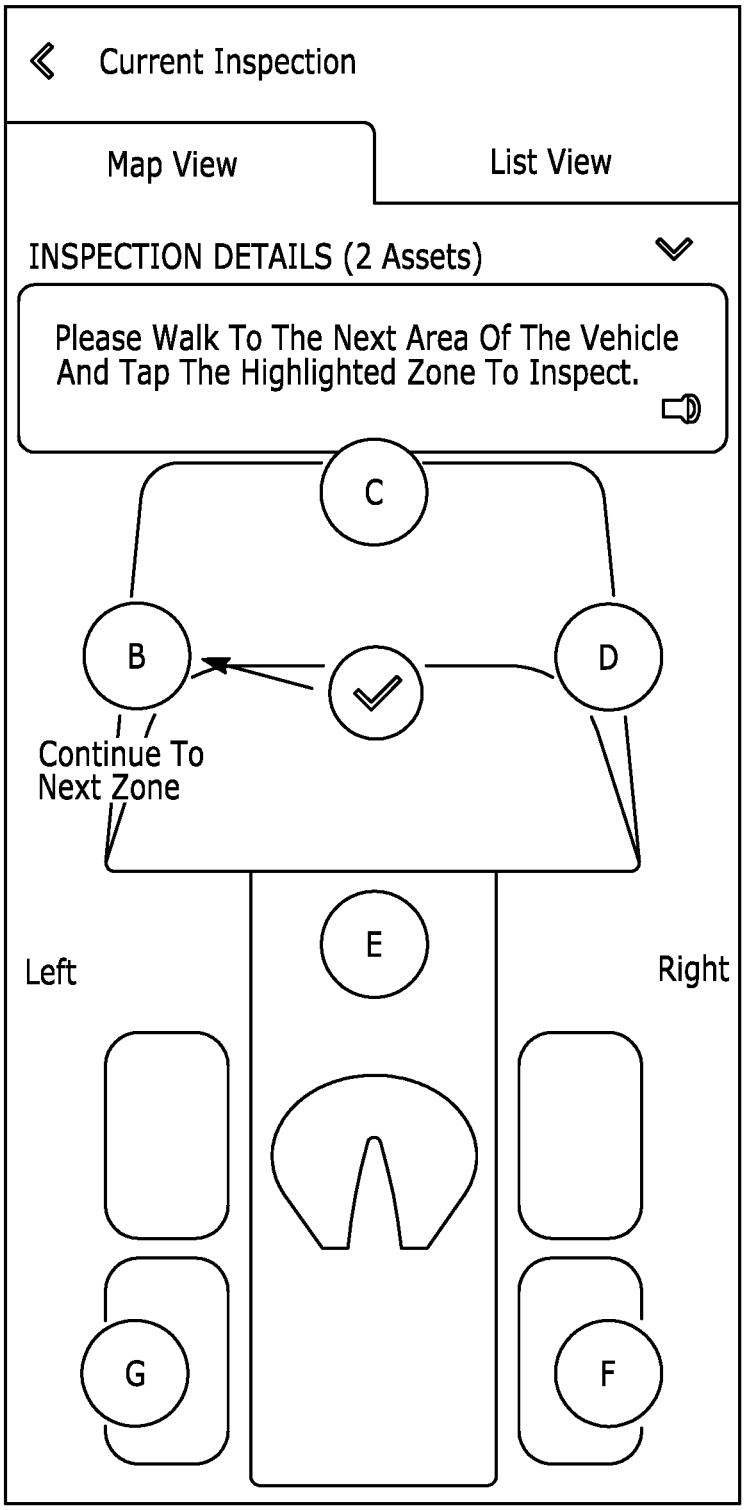
Figure 23C:
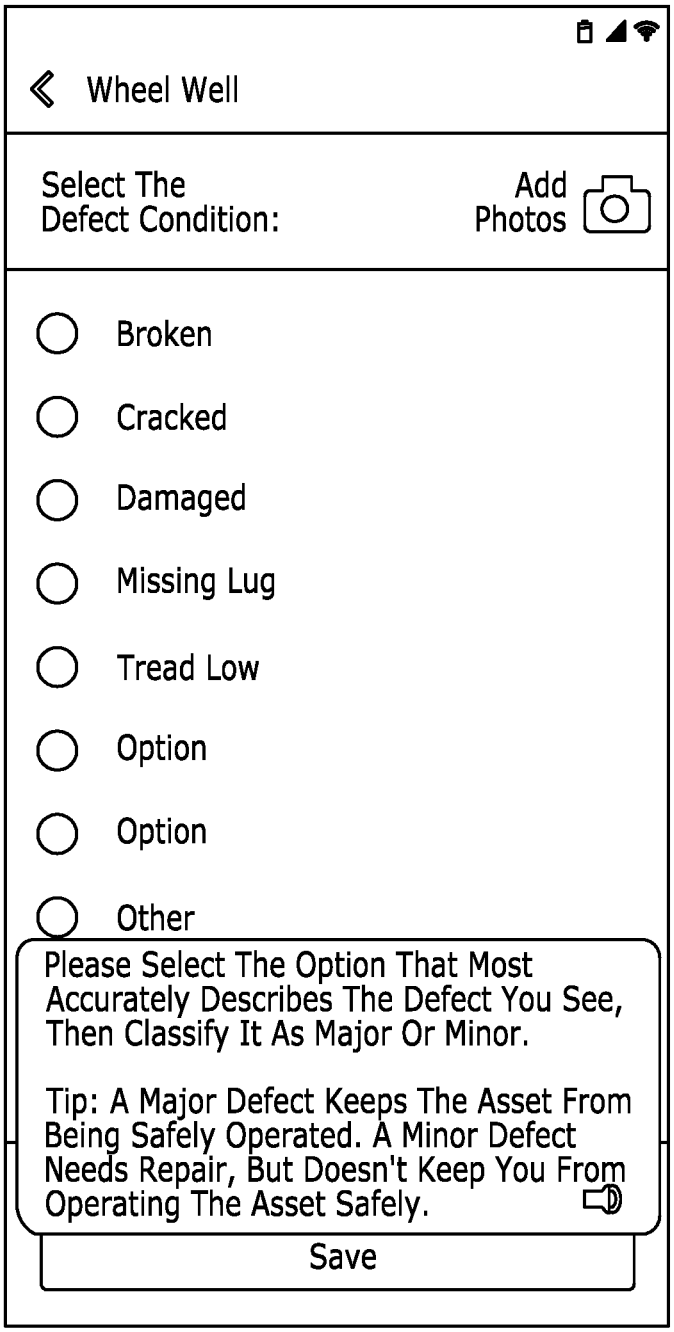
Figure 23D:
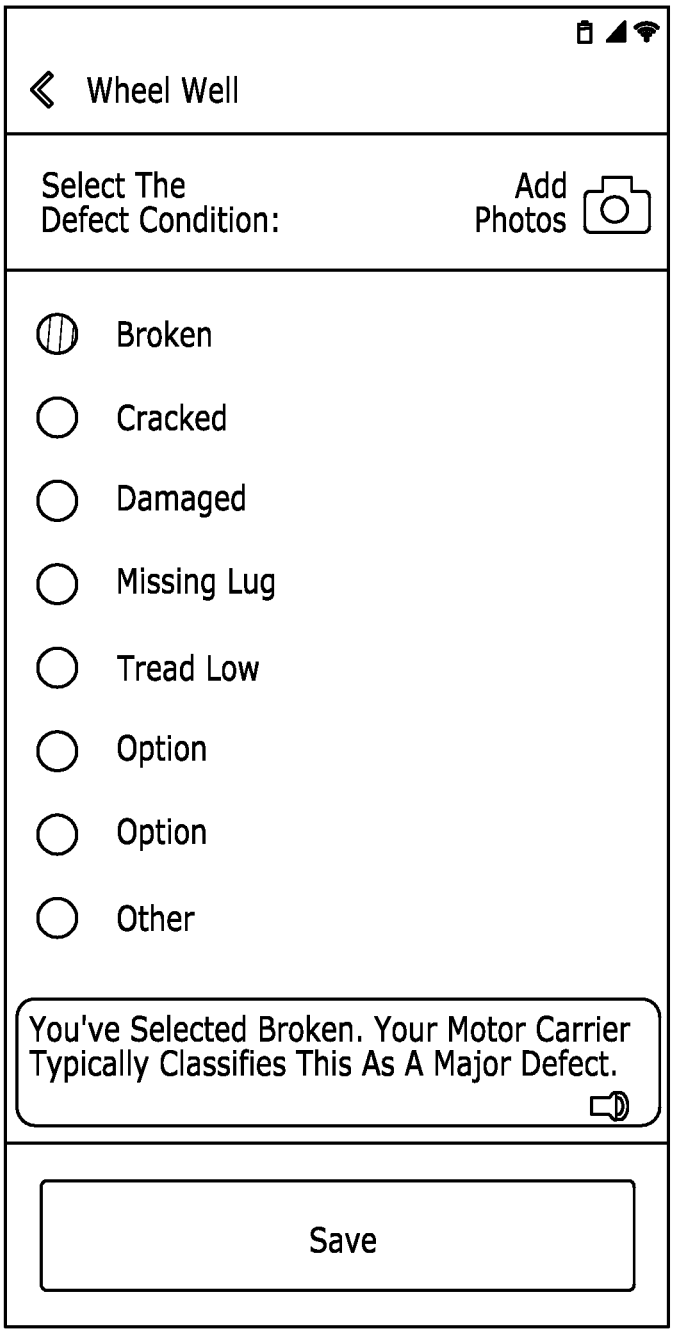
Figure 23E:
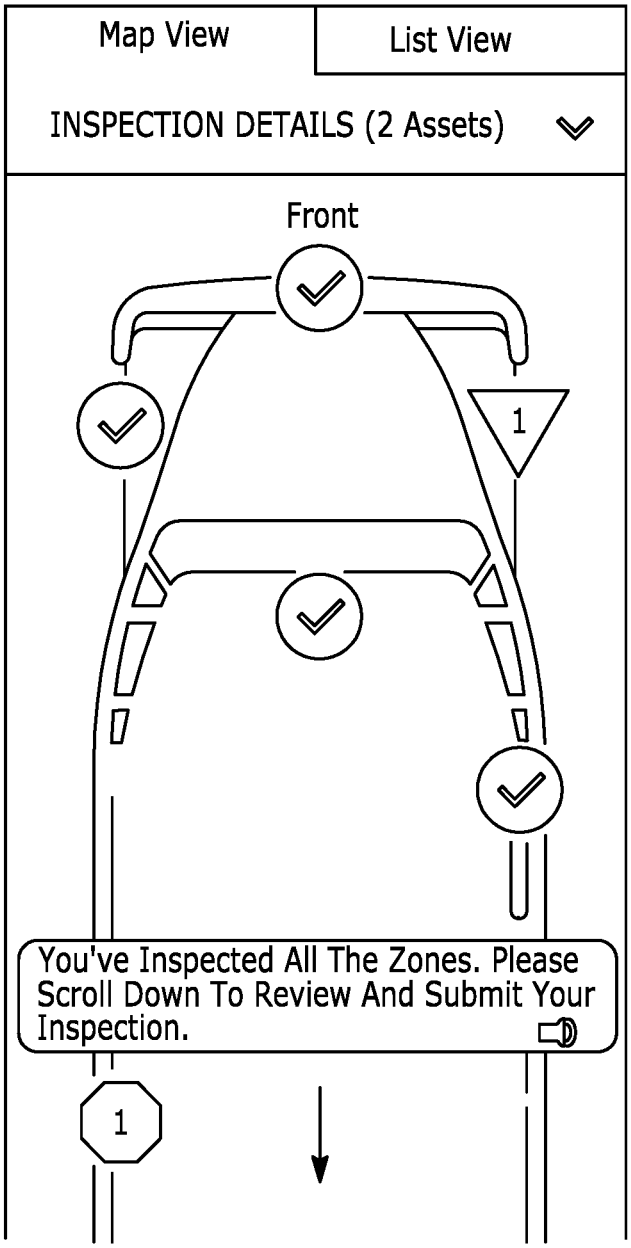

FIG. 22 is a schematic diagram depicting data flow between an inspection device and other related entities.

Visual Inspection Guidance

As the operator goes through their inspection, they are given guidance by an electronic DVIR application on how to start the inspection and next steps to take, until the inspection is completed. This allows for minimal context switching by the operator as they learn how to inspect the asset, since the learning process is integrated into the DVIR inspection workflow itself.

Incorporating visual guidance for an inspection workflow into an electronic DVIR solution, in accordance with embodiments of the invention, increases inspection efficiency and decreases time to train operators who are unfamiliar with conducting inspections, operators who are unfamiliar with motor carriers' inspection policies, and operators who are unfamiliar with the layout of specific asset make/models.

As an operator goes through their inspection, they are given guidance by the electronic DVIR application on how to start the inspection and next steps to take, until the inspection is completed. This can be customized to fit any motor carriers' policies and workflows, various asset types, and can be combined with visual representations of the asset to aid the operator. It can also optionally be toggled on or off by the motor carrier or operator.

This solves the issue of reduced productivity due to multitasking by integrating the training or tutorial into the actual electronic DVIR workflow.

Customization to fit various assets, zone configurations, and workflows allows motor carriers to leverage this as a tool to reduce the training time for new operators in their fleet, by surfacing (i.e., displaying to the user) next steps right away, rather than having to ask the operator to refer back to custom training, policy, or other instructions provided by the motor carrier.

Use Cases

Inspection Guidance in Combination with Visual Representation or Illustration of the Asset As the operator conducts their inspection, a visual representation of the asset is displayed on the electronic DVIR solution. The visual representation shows indicators and text, animated, tactile, or tactile guidance to show the operator where to proceed on the physical asset in order to complete the next step of the inspection.

When the operator starts their inspection, they will be directed with respect to which zone to inspect first. As the operator completes each step, the guidance updates until the operator has completed their inspection. When the inspection record is complete, the electronic DVIR solution may direct the operator on how to certify and submit their inspection to the motor carrier.

Should the operator fail to complete a step in their inspection, they may be given further guidance to redirect them back to that step, or they may be optionally allowed to skip it.

Inspection guidance may show the operator how to proceed from zone to zone within the asset. If the operator is inspecting multiple assets, it may indicate to the operator when to move from inspecting one asset to another. In addition, guidance may also show an operator how to inspect various components within a zone and file defects, as well as the severity of those defects, for those components.

Audio or Visual Guidance to Complete Inspection of Zones and Components

The motor carrier or electronic DVIR solution provider may include audio or video as part of the inspection guidance. Sound or video files may be included as part of the electronic DVIR solution, or may be included in custom inspection types for the motor carrier.

Audio or video guidance may be required viewing as part of the inspection workflow, or may be toggled on and off by the motor carrier, electronic DVIR solution provider, or operator.

Configurable Direction of Asset Inspection Guidance

Operators usually proceed in a circular pattern around any asset(s) they may be inspecting during their DVIR. As the operator moves from zone to zone, inspection guidance will indicate the next zone to inspect until the inspection record is filled out.

Motor carriers or operators may choose to toggle directional guidance on or off for any or all inspection types and/or any or all asset types. Motor carriers may customize the direction they want the operator to proceed around the asset(s), to direct the operator to go clockwise, counterclockwise, or a custom-defined order as they complete zones.

Configuration of Inspection Guidance Based on Asset Type, Make, or Model; or Inspection Type By default, inspection guidance will follow the order of assets, zones, and components as they are added to the inspection, either by operator input or by ordering of items within the file(s) that outline the workflow of inspection type(s) within the electronic DVIR solution.

Motor carriers may have the option to customize inspection types to enforce an order of inspection for assets, zones, and components, and may link customized inspection guidance with inspection types, and/or asset make and model. Should the motor carrier choose to enforce order of inspection, this will override the default inspection ordering and inspection guidelines shown to the operator will update to reflect this.

Configurable Indicator Types

Indicators of zone location, inspection direction, and component location can take on a variety of forms including, but not limited to:

Visual elements
Illustrations
Animations
Pictures
File attachments
Audio
Video
Tactile Feedback
Text
Integers Electronic DVIR solution providers or motor carriers can customize the inspection guidance with any combination of these at any point in the inspection workflow.

Guidance Using Tokens, Objects, or Visual Cues

Inspection guidance may also reference inspection tokens, objects, or visual cues that are attached to the asset. The guidance may direct the operator to approach or interact with any of these as part of the inspection workflow and record the results as a part of the inspection record.

Indicator of Operator's Location in Relation to Inspection Guidance

The audio or visual inspection guidance may also include indicators of the operator's physical location in relation to the asset. This may be static or update in real-time according to the operator's movement and may be derived from data collected by the mobile inspection device or by using sensor or camera equipment attached to the asset.

Likewise, as an operator approaches and inspects a zone or component, the audio or visual guidance may adapt to the operator's location in relation to them, or their actions as they go about the inspection. This may be recorded as part of the inspection record and replayed later by the operator or motor carrier.

Embodiments of the invention provide for: reducing time spent to train operators to conduct asset inspections through audio or visual inspection guidance as part of an electronic DVIR solution; audio or visual inspection guidance in combination with a visual representation of the asset to reduce time to train operators; and ability to configure audio or visual inspection guidance for:

- Direction operator should be proceeding in regard to next inspection step;
- Types of identifiers present;
- Visual elements;
- Illustrations;
- Pictures;
- File attachments;
- Audio;
- Tactile Indicators;
- Text;
- Integers;
- Integration with physical tokens or indicators on the asset;
- Linking of inspection guidance to asset types, makes, and models; and
- Linking of inspection guidance to inspection types.

FIGS. 23A-23E depict an example implementation inspection guidance in combination with visual representation or illustration of the asset. Also depicted are: guidance using tokens, objects, or visual cues, audio or visual guidance, and some of the different ways that guidance may be used during the inspection workflow to instruct the operator.

FIG. 24 depicts an example implementation of configurable inspection guidance, configurable indicator types, and configuration of inspection guidance based on asset type, make, or model, or an inspection type, including an example of a tool that allows a motor carrier to customize how guidance is shown to operators in their fleet for various inspection types and asset types.

Figure 25:
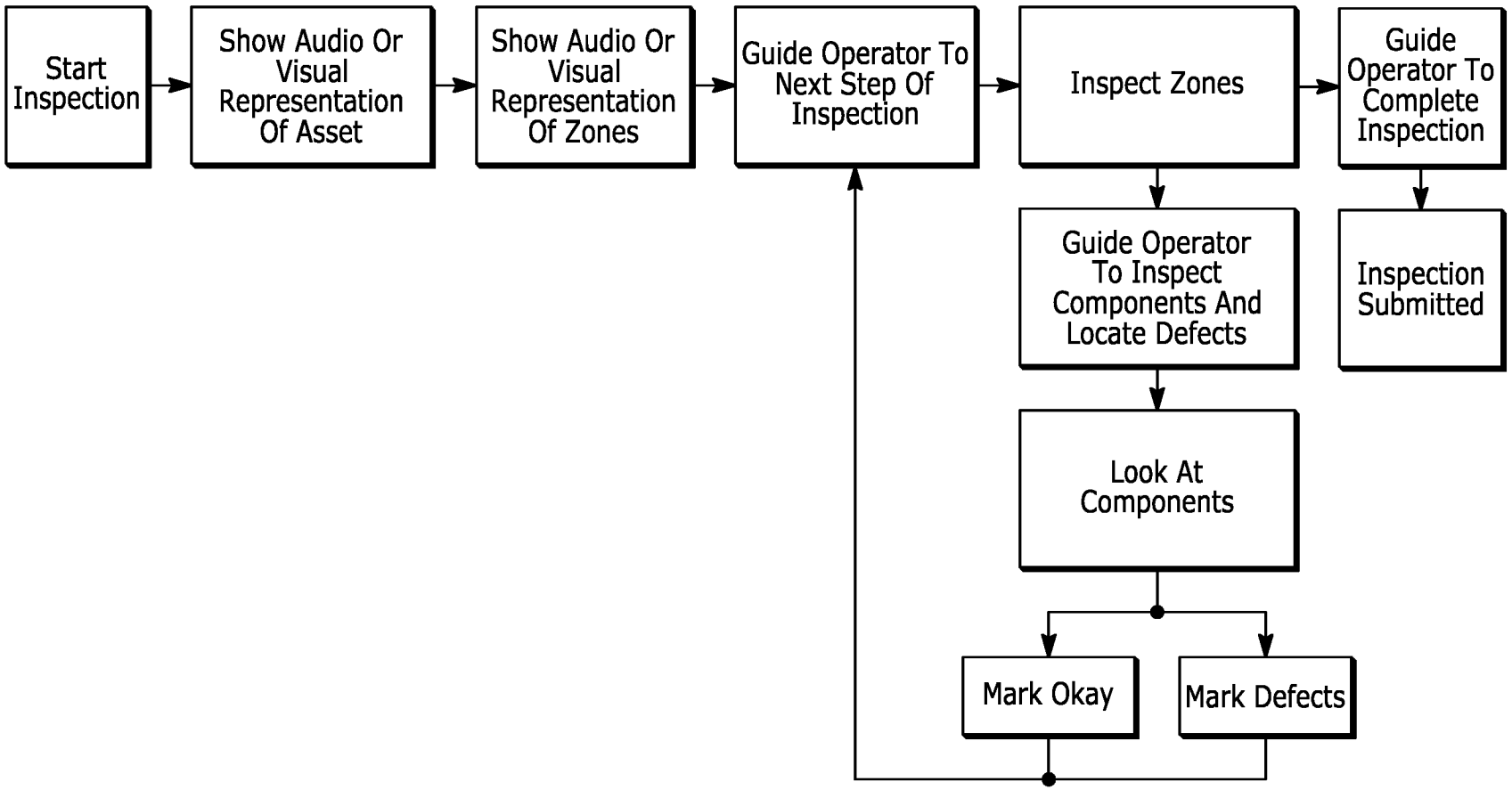
FIG. 25 depicts reducing time spent to train operators to conduct asset inspections through audio or visual inspection guidance as part of an electronic DVIR solution.

FIG. 25 depicts reducing time spent to train operators to conduct asset inspections through audio or visual inspection guidance as part of an electronic DVIR solution. Audio or visual inspection guidance may be combined with a visual representation of the asset to reduce the amount of time that it takes to train operators. FIG. 25 shows where inspection guidance may be employed to train and/or guide operators during the inspection process.

Figure 26:
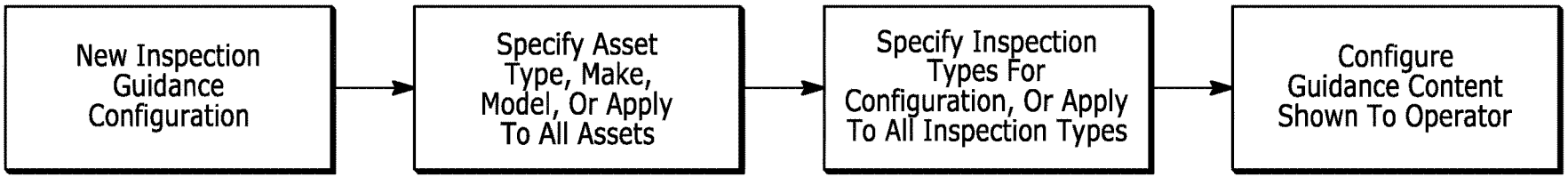
FIG. 26 depicts configuring audio or visual inspection guidance and linking guidance to inspection types and asset types, makes, and models.

FIG. 26 depicts configuring audio or visual inspection guidance and linking guidance to inspection types and asset types, makes, and models. FIG. 26 depicts how a motor carrier may configure inspection guidance.

Figure 27:
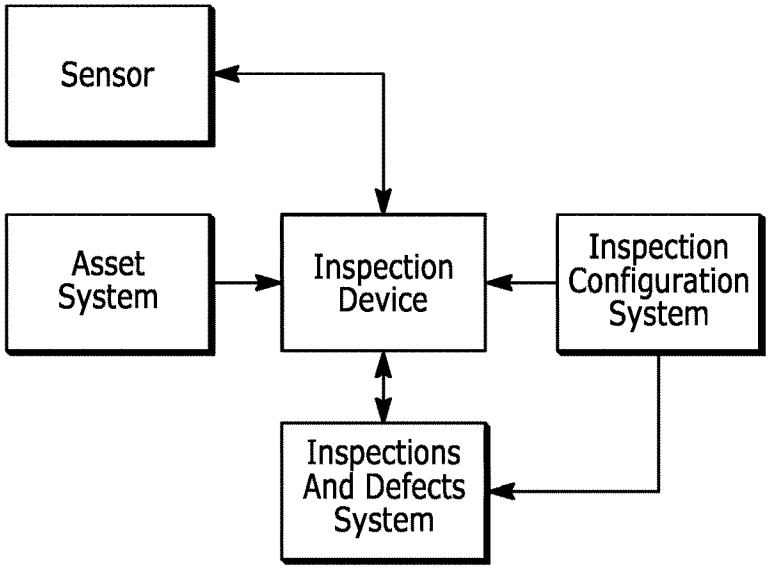
FIG. 27 is a schematic diagram showing how a mobile inspection device interacts with data and other entities.
Figure 28A:
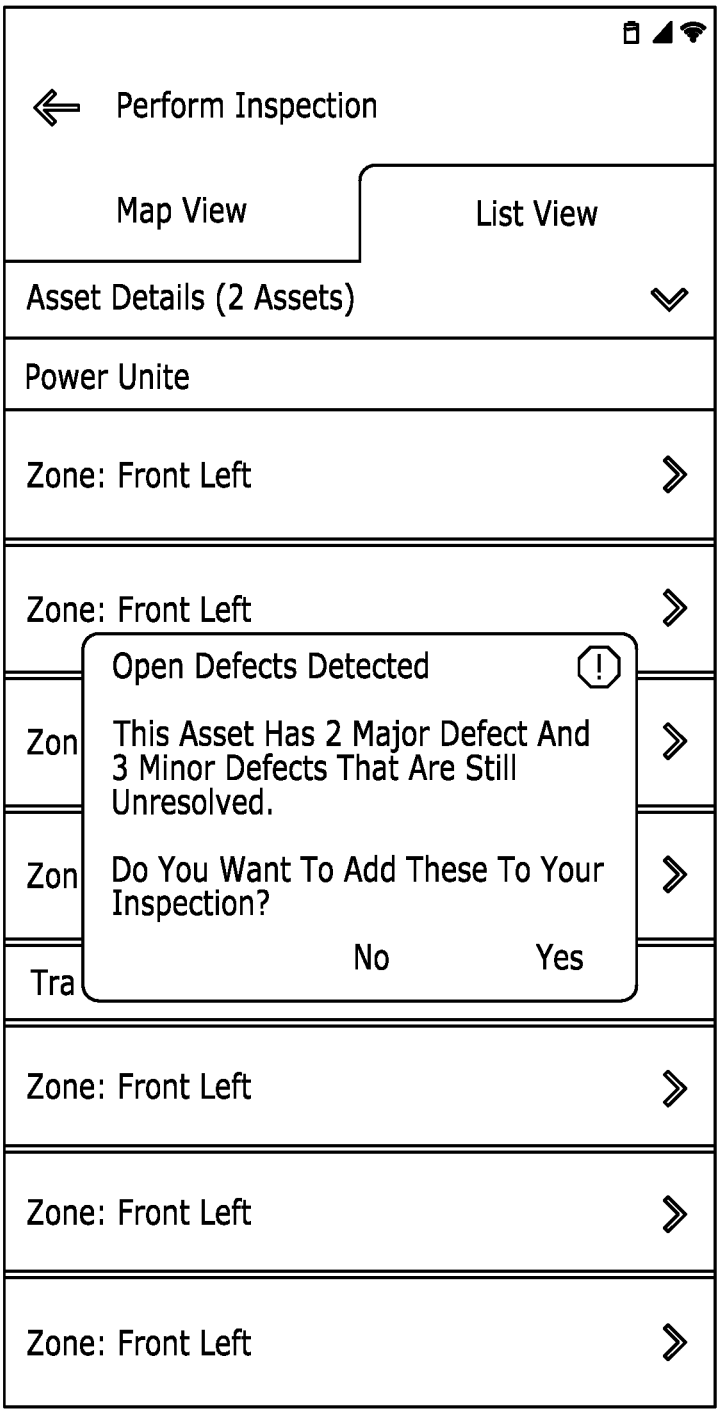
Figure 28B:
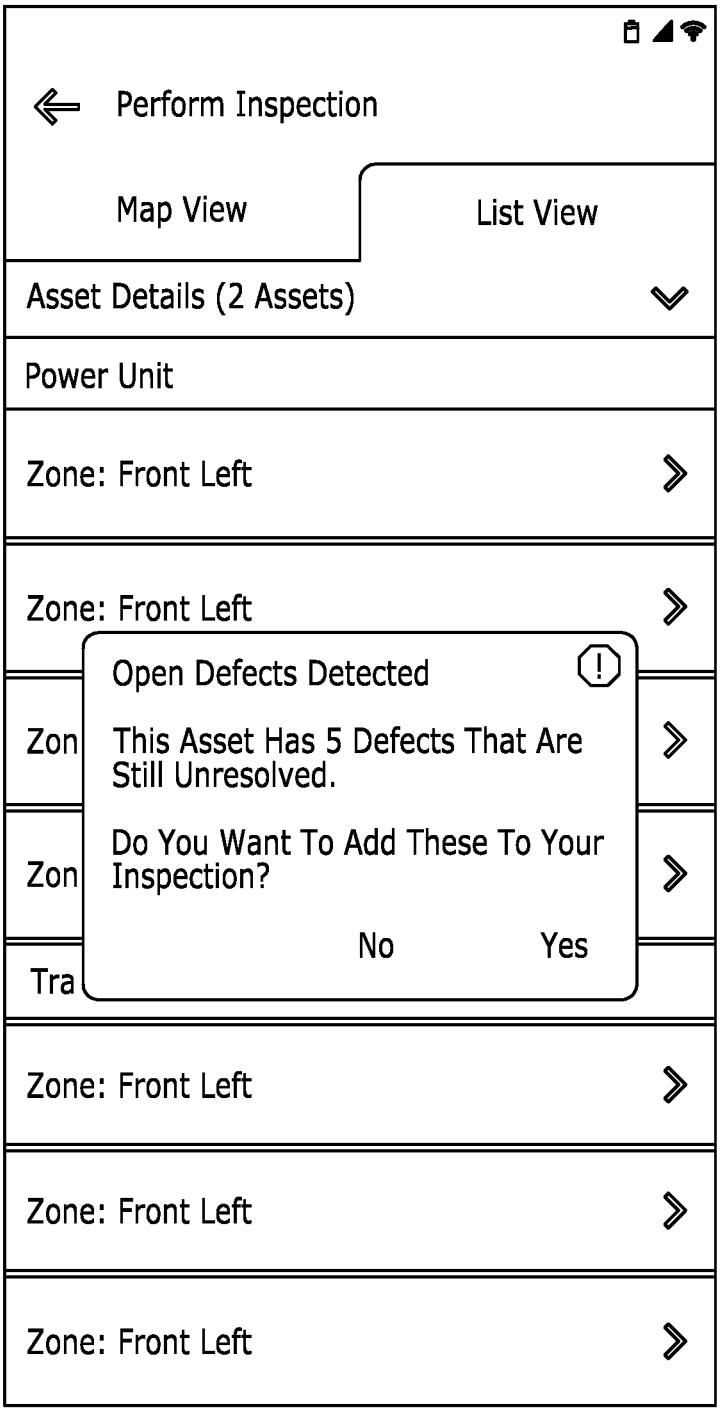
Figure 28D:
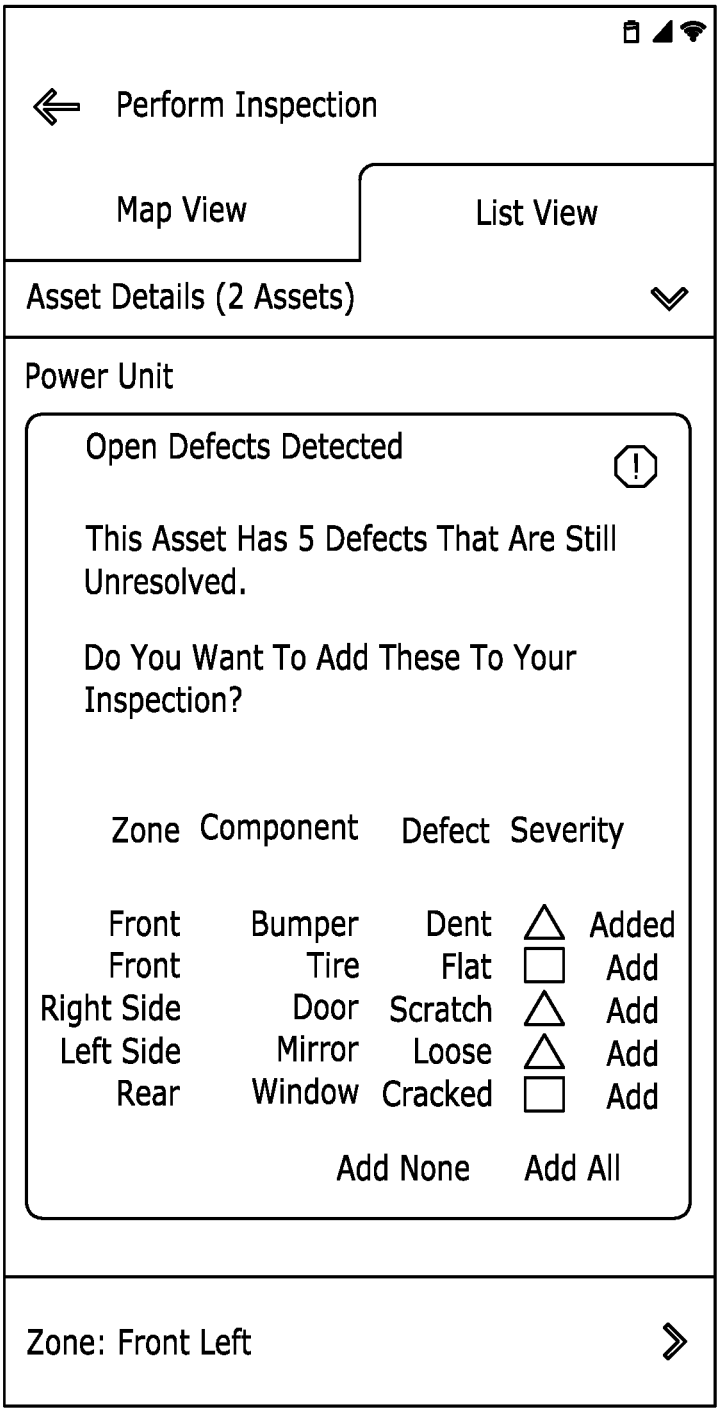
Figure 28E:
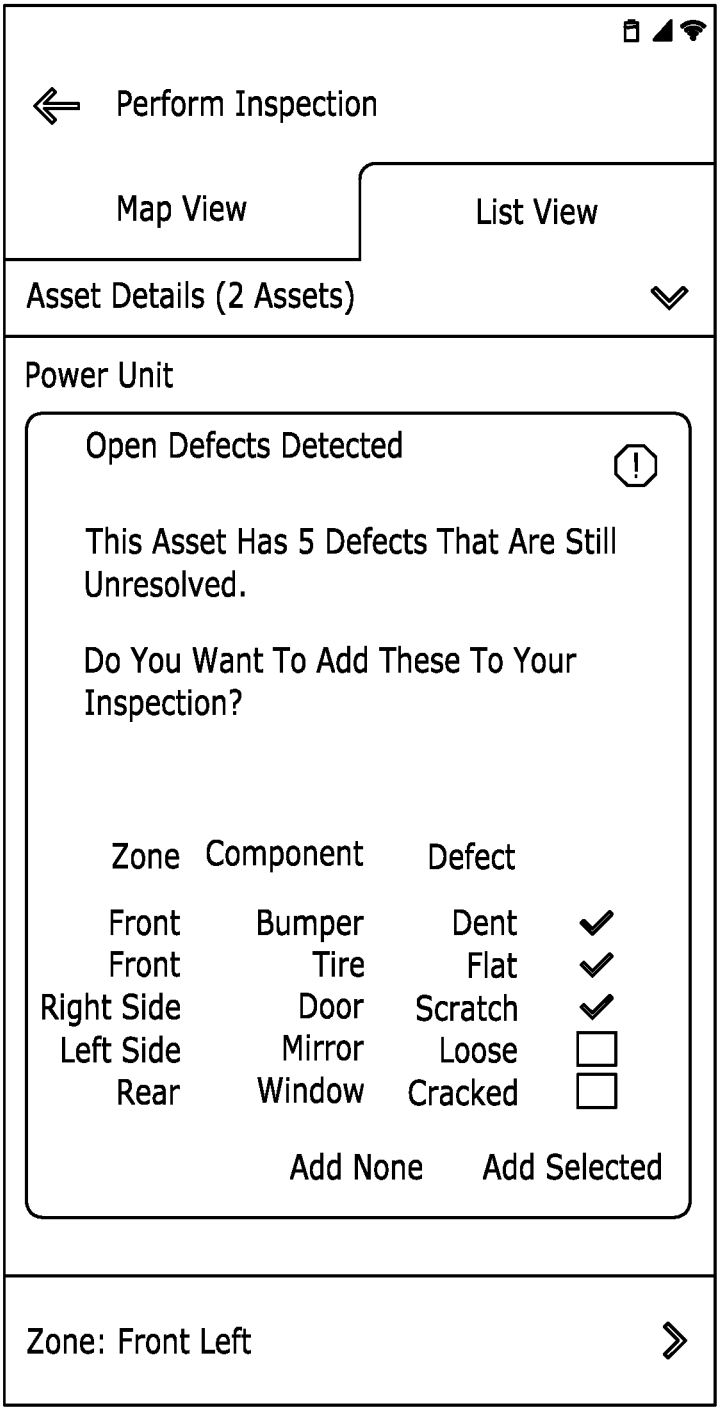

FIG. 27 is a schematic diagram showing how a mobile inspection device interacts with data and other entities.

Visual inspection guidance, as described above, advantageously reduces an amount of context switching performed by the operator that is associated with the other possible solutions. With other solutions, a user needs to switch back and forth between the training materials and their DVIR inspection. But integrating the guidance into the DVIR inspection calls for less context switching by the user/operator.

Pre-Populate Inspection Defects

Existing forms for conducting Daily Vehicle Inspection Reports (DVIRs), as well as all existing solutions for conducting electronic DVIRs, do not give users the ability to see all open defects for the asset they are inspecting. As a result, a operator may be assigned to operate an asset which they or the motor carrier are not aware has an open defect filed by another operator. If the operator does not detect this open defect during their own inspection, they will unknowingly operate an asset which poses a danger to themselves or others.

In accordance with embodiments of the invention, the mobile inspection device queries electronic-DVIR records for the asset and shows the operator, via the mobile inspection device, defects of the asset that are still open. The in-progress inspection record may then be pre-populated with the open defects.

Problem

Existing forms for conducting Daily Vehicle Inspection Reports (DVIRs) as well as existing solutions for conducting electronic DVIRs do not give users the ability to see all open defects for the asset they are inspecting. For existing electronic DVIR solutions, a summary of defect information for assets is often presented to the motor carrier through a SaaS online portal, but there is also no direct way for a motor carrier to communicate all open defects for an asset to the operator. The operator is only required to review the most recent inspection report for the asset, which may have been performed by another operator and, due to user error, may not encompass all defects currently affecting the asset. Furthermore, due to the time constraints often imposed on the motor carrier by daily operations, they often do not have the time available to check the asset's full defect records prior to the operator inspecting the asset. As a result, an operator may be assigned to operate an asset which they or the motor carrier are not aware has an open defect filed by another operator. If the operator does not detect this open defect during their own inspection, they will unknowingly operate an asset which poses a danger to themselves or others.

Even if the operator detects the defect, they waste unnecessary time going through the inspection only to find the defect, and request a new asset from the motor carrier.

Motor carriers also run into issues with record keeping after adopting electronic DVIR solutions, as their staff are still learning how to use the products. Should a mechanic physically repair a defect on an asset but forget to mark it in the electronic DVIR solution, the motor carrier has inaccurate records indicating the defect is still open, which may lead law enforcement authorities to believe the motor carrier is illegally operating assets with defects that prevent their safe operation. However, there is often no means of alerting or reminding the motor carrier that an employee should check to ensure the defect was repaired.

Solution

The mobile inspection device queries electronic-DVIR records and shows the operator defects that are still open for the device. The in-progress inspection record may then be pre-populated with the open defects.

This solves for the risk of operators potentially missing open defects reported by another operator during their own inspection, as this information is brought to their attention through the electronic DVIR solution.

This also solves the issue of the operator being unaware of open defects when they are assigned to inspect the asset, as this information can be brought to the operator's attention before they start their own inspection of the vehicle.

Furthermore, this also serves as a potential alerting mechanism to the motor carrier and its employees of defects that may have mistakenly not been marked repaired or resolved. If the operator is alerted to an open defect that they can see is not physically there, they have the opportunity to alert the motor carrier to the inaccurate defect record.

Use Cases

Showing Operator Open Defects for Asset With Option to Add Defects to Inspection When the operator starts their inspection, they are provided with a summary of open defects for the asset(s) they have designated as part of the inspection. This may take the form of a list, text summary, audio description, graphic, animation, or any of the above, and may show the zone and component which each defect belongs to.

The operator will be given the option to add all, none, or select defects from this list to their inspection record. This will not resolve or amend the defects in any way but would rather copy the defect information into the in-progress inspection record.

When added to the in-progress inspection record, the copy of the defect information will take on the metadata, including inspecting operator and timestamps, of the in-progress inspection.

Read-Only Display of Open Defects for Asset

Alternately, the electronic DVIR solution provider, motor carrier, or operator may customize this feature to show a read-only display of open defects for the asset(s) selected for inspection. This would not give the operator the ability to add the defects to their inspection record from that screen, but would merely alert the operator to the presence of those defects. The operator can then choose whether or not to manually add similar information to their inspection record during their inspection.

Automatic Pre-Population of Existing Open Defects for Asset

Alternately, the electronic DVIR solution provider, motor carrier, or operator may customize this feature not to require operator interaction in order to populate the in-progress inspection record with open defect data. This may or may not show the open defect information to the operator before automatically populating the in-progress inspection record with a copy of all open defect information for the asset.

The operator is given an option to delete automatically prepopulated defects from their in-progress inspection record before submitting the inspection to the motor carrier.

Surfacing Open Defect Information at Different Areas in the Inspection Workflow

The electronic DVIR solution provider, motor carrier, or operator may customize this feature to show the open defect information to the operator at different points in the inspection workflow. The operator may see the open defect information:

After identifying the asset(s) to inspect but before starting the inspection workflow.

At the start of the inspection workflow.

During the inspection workflow, as the operator is entering in required information about the asset.

At the end of the inspection workflow, before the operator submits their inspection record.

Querying Inspection Records or Defect Records

In order to retrieve open defects for the asset(s) selected for inspection, the electronic DVIR solution may query entire inspection records for the motor carrier to find defects, or optionally, it may selectively query all records of defects for the motor carrier.

Querying Defect Statuses and Repair Records to Identify Defects to Synchronize to Inspection Device In order to further narrow down the open defects for the asset, the electronic DVIR solution may query for defect statuses and/or repair records for the motor carrier to exclude defects that have already been resolved. Once open or unresolved defects have been identified, the electronic DVIR solution will send them to the mobile inspection device to display to the operator.

As such, embodiments of the invention provide for querying all inspection records or defect records for open defects on the asset(s) selected for inspection; syncing all open defects for asset(s) to a mobile inspection device; and inserting pre-existing open defects, with or without user interaction, into an in-progress inspection record.

FIGS. 28A-28E depict displaying to an operator open defects for asset with an option to add defects to an inspection. Adding the pre-populated defects is an option that is given to the user. Varying levels of detail are depicted as are different ways of displaying and adding these pre-populated defects to the inspection.

Figure 29:
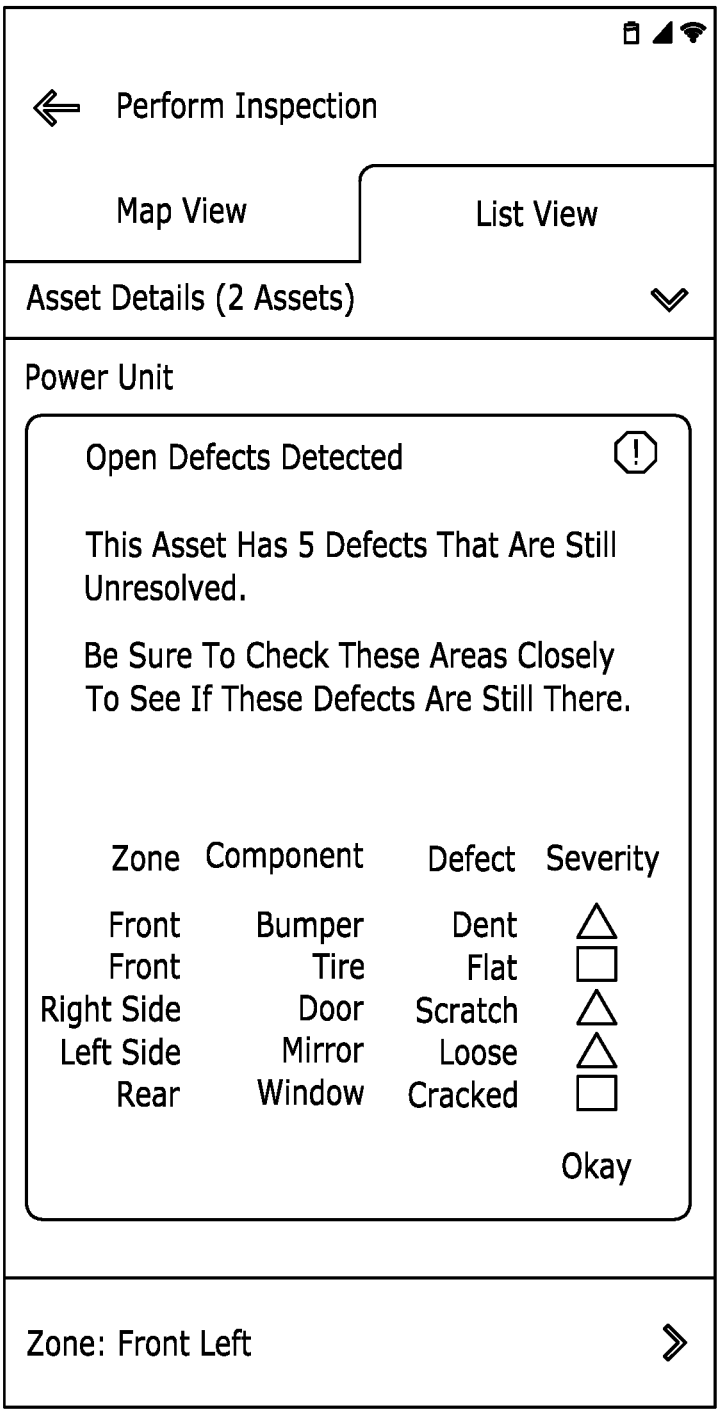
FIG. 29 depicts an example read-only display of open defects for an asset.

FIG. 29 depicts an example read-only display of open defects for an asset. The operator may manually enter defects into an inspection and allows the "pre-population logic" to function as a warning of defects that the operator should look for when conducting their own inspection.

Figure 30:
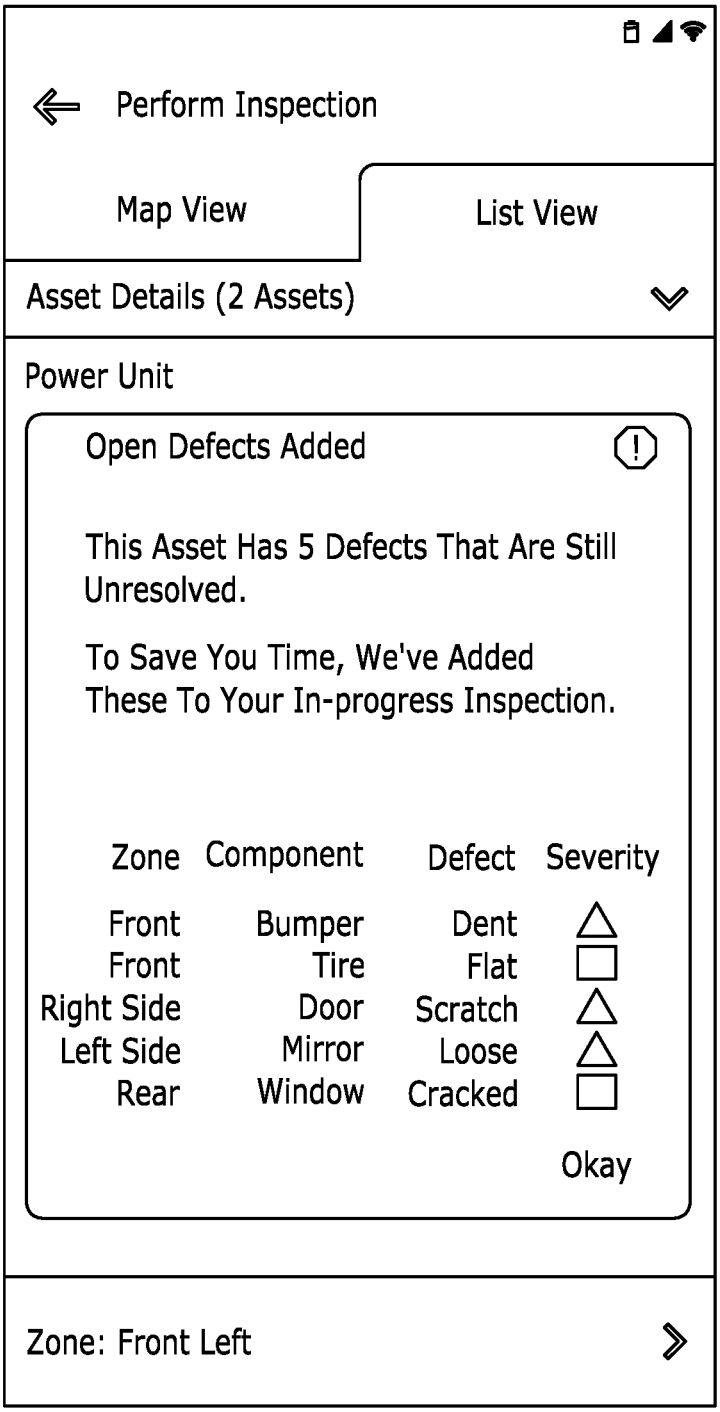
FIG. 30 depicts an example of automatic pre-population of existing open defects of an asset into an inspection report.

FIG. 30 depicts an example of automatic pre-population of existing open defects of an asset into an inspection report. In this example, the addition of pre-populated defects is assumed to be mandatory for the operator. The operator is informed of what has been added to the inspection and is given no option to defer adding those items to the inspection report.

Figure 31A:
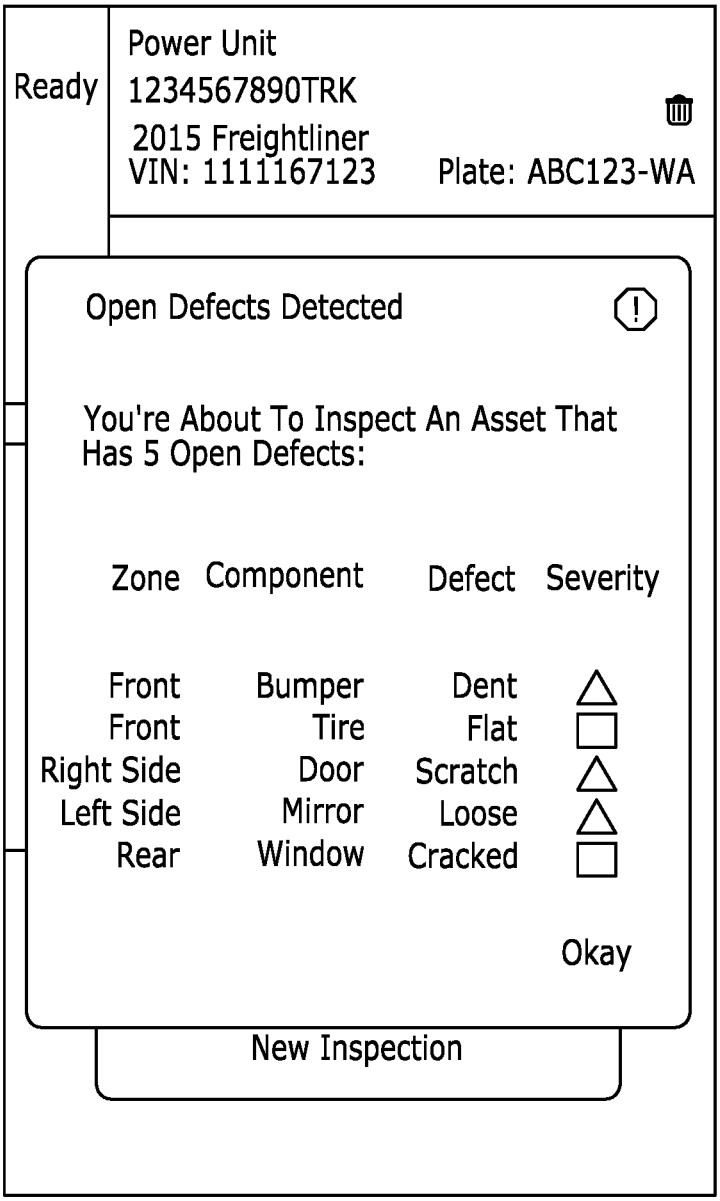
FIGS. 31A-31B depict surfacing open defect information at different areas in the inspection workflow (inspection start, read-only and actionable).
Figure 31B:
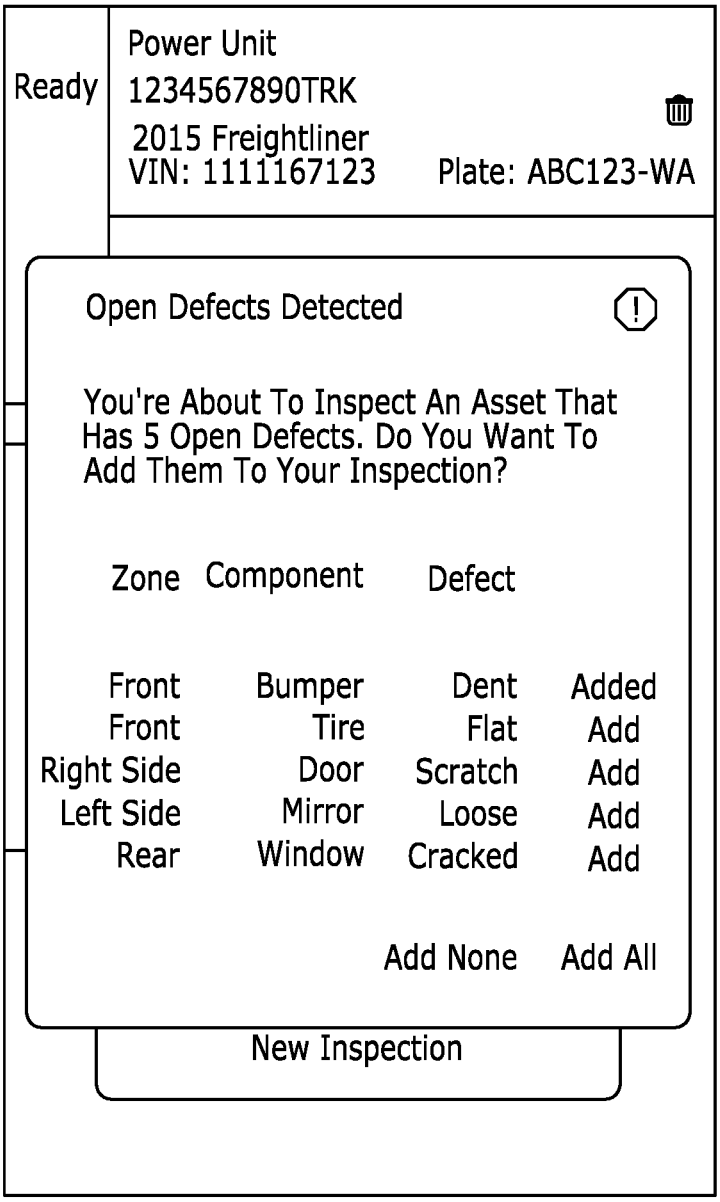

FIGS. 31A-31B depict surfacing open defect information at different areas in the inspection workflow (inspection start, read-only and actionable). FIGS. 31A and 31B depict how an operator can be made aware of mandatory and/or optional addition of open defects to the inspection as soon as the operator identifies the asset that they are inspecting, but before they start the inspection process. Showing the open defects sooner in this way gives the operator an idea of what to look for before they start physically interacting with asset zones. Giving the option to add the defects to a new inspection allows the driver to make a choice about what goes into the inspection (being as it is a legal document that they must sign) and, should the driver want the pre-populated defects as part of their inspection, allows them to add this data in the fastest way possible.

Figure 32B:
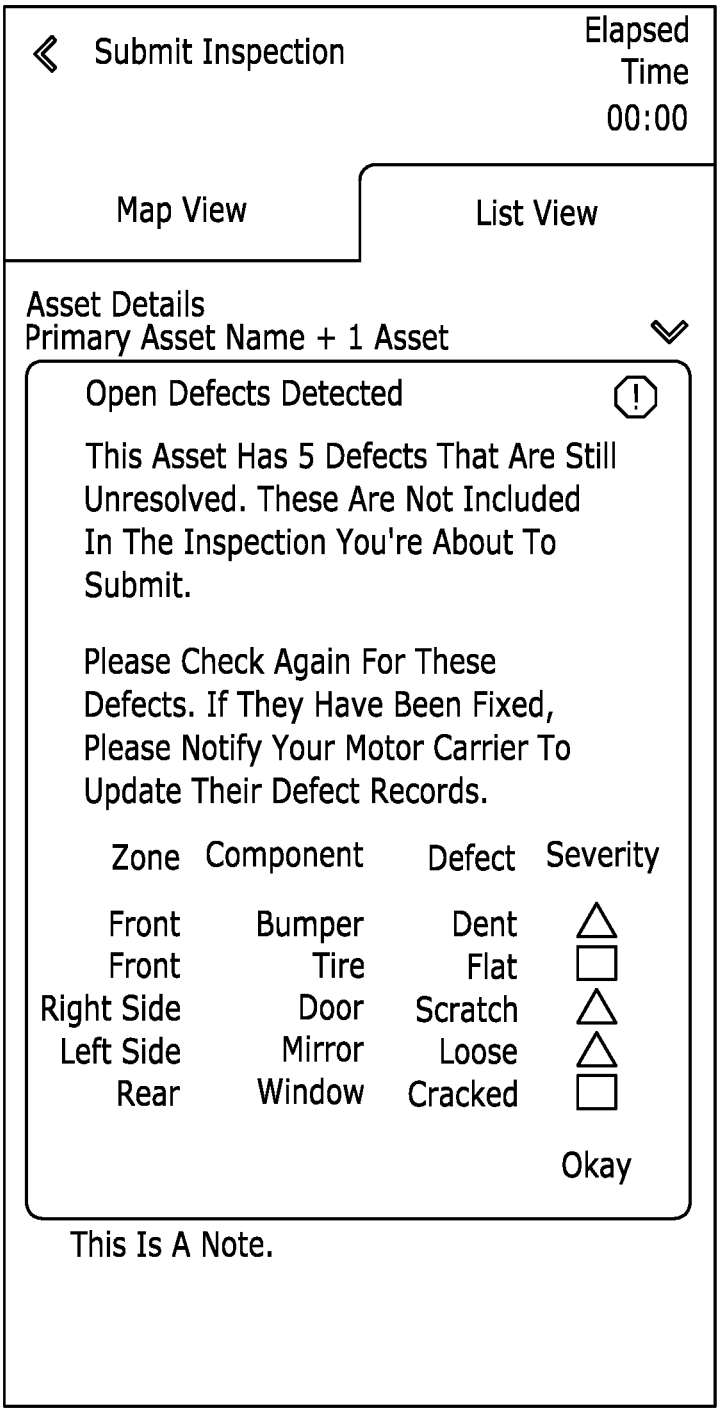

FIGS. 32A-32B depict examples of surfacing open defect information at different areas in the inspection workflow (inspection end, read-only, and actionable). FIGS. 32A-32B depict how an operator can be made aware of mandatory and/or optional addition of open defects to an inspection as soon as the operator identifies the asset they are inspecting, but at the end of the inspection process.

Figure 33:
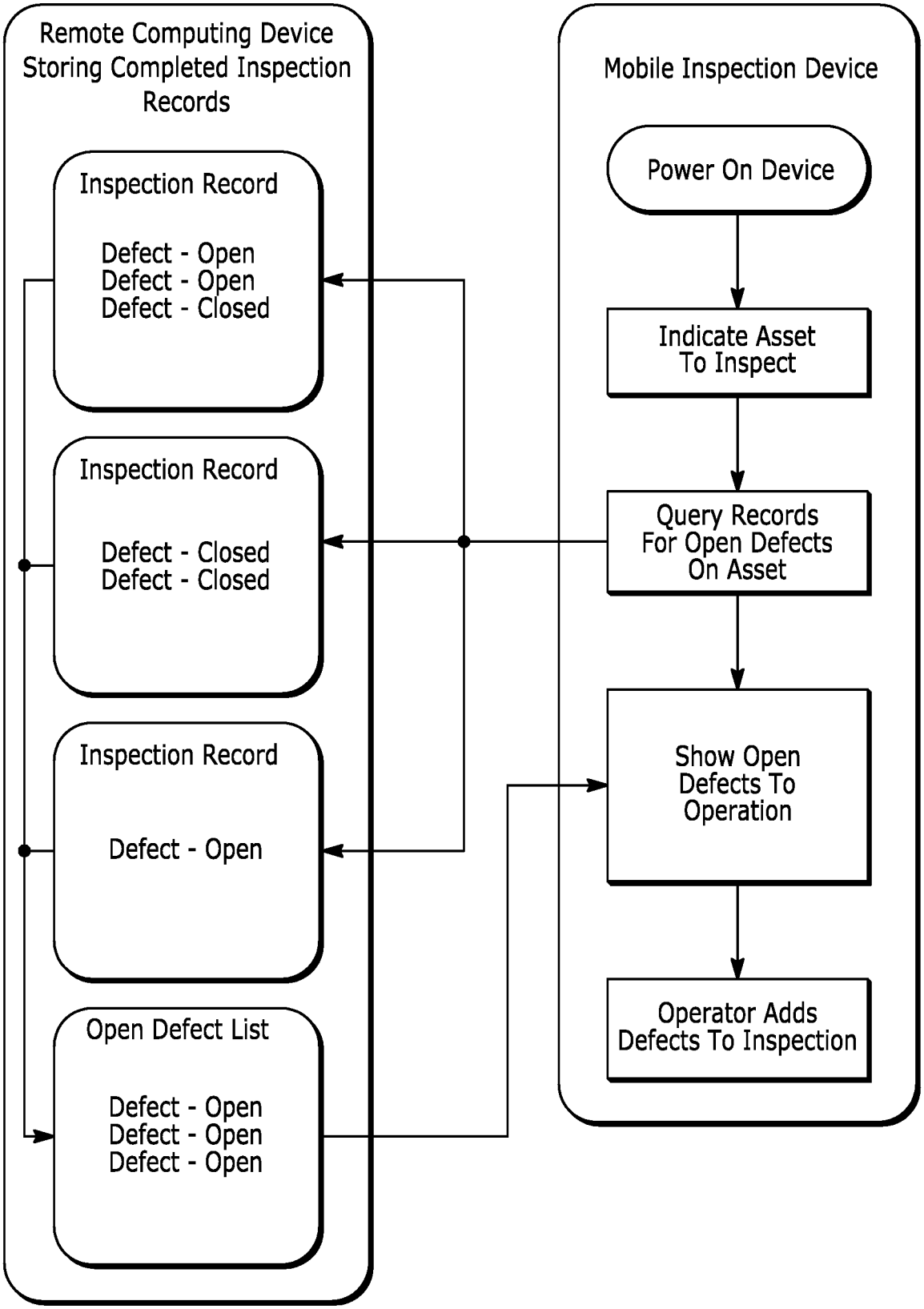
FIG. 33 is a flow diagram depicting logic for querying defect records and returning open defects of an asset.

FIG. 33 is a flow diagram depict logic for querying defect records and returning open defects of an asset. FIG. 33 depicts requesting and sending of data throughout the inspection workflow to facilitate finding pertinent open defects of an asset and surfacing (i.e., displaying) them to the operator. In this workflow, the remote computing device may filter the defects and then return open defects to the inspection device.

Figure 34:
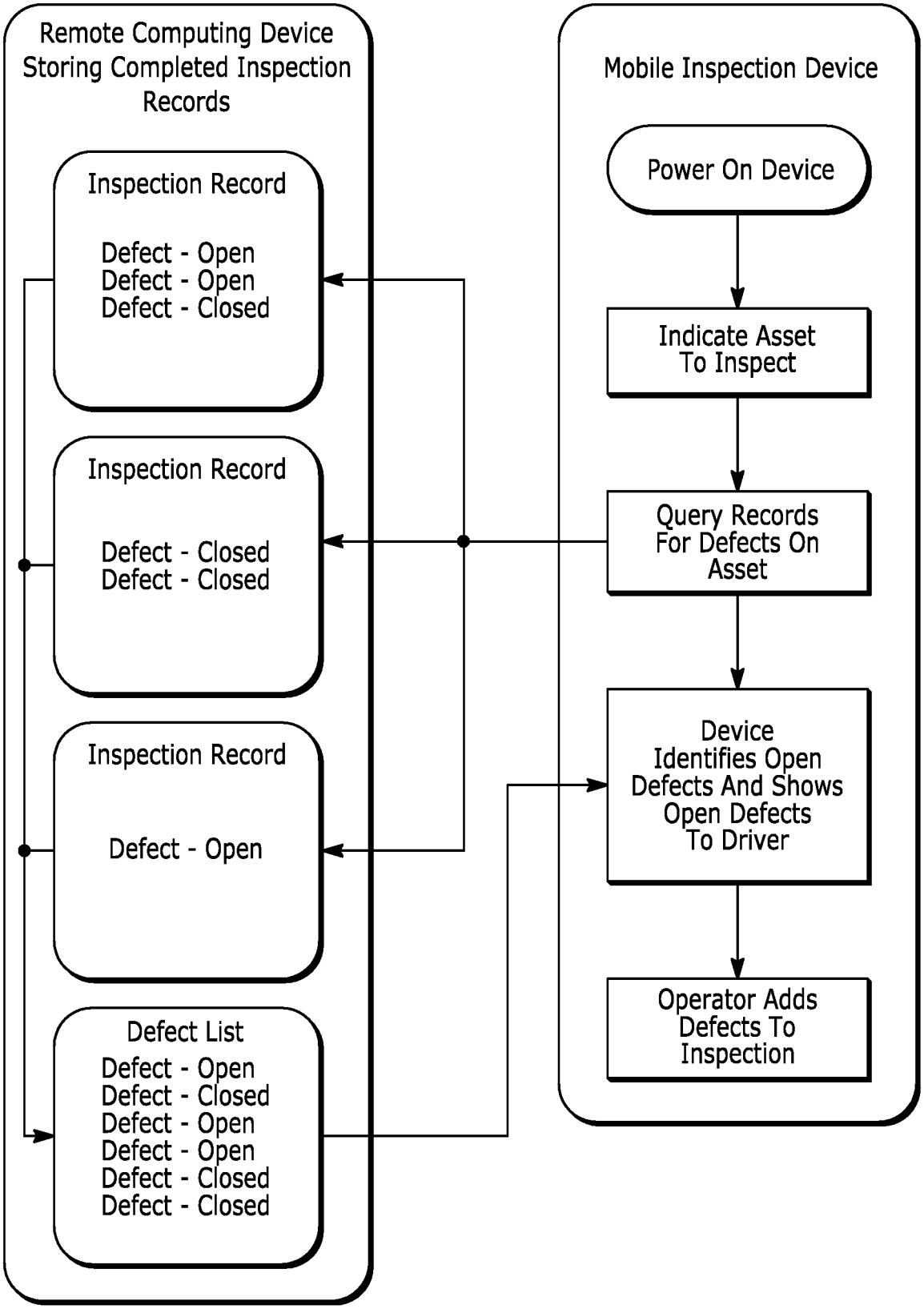
FIG. 34 is a flow diagram depicting logic for querying defect records and returning open defects of an asset.

FIG. 34 is a flow diagram depict logic for querying defect records and returning open defects of an asset. FIG. 34 depicts requesting and sending of data throughout the inspection workflow to facilitate finding pertinent open defects of an asset and surfacing (i.e., displaying) them to the operator. In this workflow, the remote computing device returns all defects for the asset to the inspection device, and the inspection device filters the defects to show the operator the only open ones.

Figure 35:
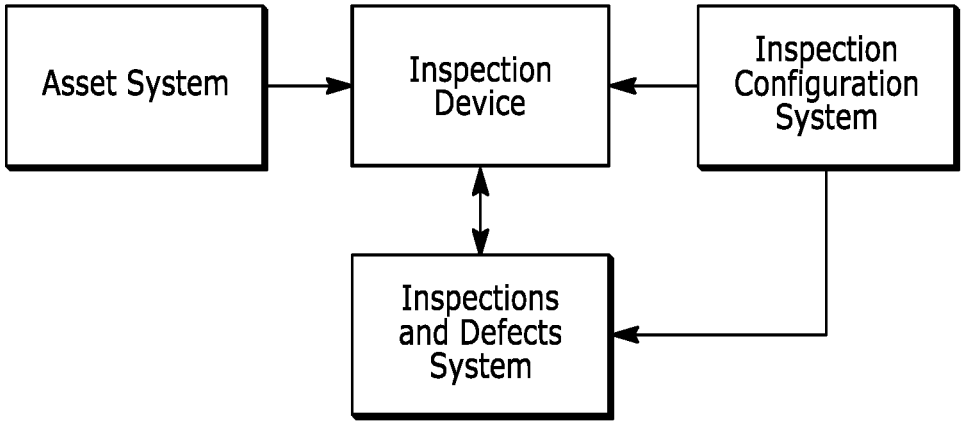
FIG. 35 is a schematic diagram showing how a mobile inspection device interacts with data and other entities.

FIG. 35 is a schematic diagram showing how a mobile inspection device interacts with data and other entities.

Embodiments of the invention query open defects for the asset, both in local storage and in remote computing units. The embodiments then return this data to the device and use it to populate the inspection report.

In this way, embodiments of the invention provide increased reliability and more information. Absent these embodiments of the invention, when the inspection device has nothing in local storage, the inspector would not be aware of additional open defects even when they exist. Likewise, other solutions only return the defects noted in the last inspection—if prior inspectors noticed defects that the last inspector did not, the current inspector would not benefit from that additional information.

While the present invention has been illustrated by a description of various embodiments and while these embodiments have been described in considerable detail, it is not the intention of the applicants to restrict or in any way limit the scope of the appended claims to such detail. Additional advantages and modifications will readily appear to those skilled in the art. The invention in its broader aspects is therefore not limited to the specific details, representative apparatus and method, and illustrative example shown and described. Accordingly, departures may be made from such details without departing from the spirit or scope of applicant's general inventive concept.

The invention claimed is:

1. A method comprising:

tracking an operator's proximity to an automotive vehicle being inspected;

recording the operator's proximity to the automotive vehicle being inspected;

rendering at least one of an audio and a visual representation of the automotive vehicle being inspected;

rendering at least one of an audio and a visual representation of a plurality of inspection zones of the automotive vehicle being inspected;

rendering at least one of an audio and a visual indicator of a plurality of components within each of the plurality of inspection zones of the automotive vehicle being inspected;

updating a representation of the automotive vehicle being inspected to reflect a condition of the vehicle being inspected, a condition of each of the plurality of the inspection zones, and a respective plurality of numbers of defects for each of the plurality of inspection zones;

generating a plurality of dwell-time reports showing a duration of time spent in an overall inspection, time spent inspecting at least one of individual and multiple zones, and time spent between inspecting at least one of individual and multiple zones across a plurality of Driver Vehicle Inspection Reports (DVIR) inspections for a motor carrier that maintains a fleet of automotive vehicles that includes the automotive vehicle;

calculating and indicating at least one of abnormal data and suspicious activity in the dwell-time reports that indicates potential falsification of inspection records;

calculating and indicating data outliers in the dwell-time reports that indicate at least one of training issues and potential falsification of inspection records;

providing at least one alert to the motor carrier when inspections are submitted that contain at least one violation of at least one of: inspection-duration thresholds, zone-inspection-duration thresholds, and between-zone-duration thresholds;

displaying on at least one mobile-inspection device a plurality of indications to an operator of at least one of: the inspection-duration thresholds, the zone-inspection-duration thresholds, and the between-zone-duration thresholds set; and actively managing an inspection process by enforcing a minimum time required per zone to ensure quality of the overall inspection.

2. The method of claim 1, further comprising:

recording at least one of audio and visual representations shown as part of any defects of the vehicle being inspected.

3. The method of claim 1, further comprising:

during a vehicle inspection, displaying a visual indication of a driver's location in proximity to a visual representation of the automotive vehicle being inspected.

4. The method of claim 1, wherein actively managing an inspection process by enforcing a minimum time required per zone to ensure quality of the overall inspection further comprises:

collecting data from the at least one mobile-inspection terminal for analyzing, determining, and indicating potential falsification of inspection records, when combined with inspection, zone, and between-zone durations.

5. The method of claim 4, wherein the inspection-duration thresholds are set manually by the motor carrier.

6. The method of claim 4, wherein the zone-inspection-duration thresholds are set manually by the motor carrier.

7. The method of claim 4, wherein the between-zone-duration thresholds are set manually by the motor carrier.

8. The method of claim 4, further comprising: providing guidance, from an electronic DVIR application, regarding how to start an inspection and a plurality of next steps to take, until the overall inspection is completed thereby allowing for minimal context switching by an operator as the operator learns how to inspect the automotive vehicle.

9. The method of claim 8, further comprising:

querying, by the mobile inspection device, electronic-DVIR records stored by a computer that is remotely located from the mobile inspection device;

displaying to the operator, via the mobile-inspection device, defects of the automotive vehicle that remain open; and pre-populating, with the defects of the automotive vehicle that remain open, an in-progress inspection record thereby reducing a likelihood of the operator potentially missing open defects reported during a previous inspection of the asset.

* * * * *